US009280133B2

(12) United States Patent
Yoshida et al.

(10) Patent No.: US 9,280,133 B2
(45) Date of Patent: Mar. 8, 2016

(54) DEVELOPMENT DEVICE, PROCESS CARTRIDGE, AND IMAGE FORMING APPARATUS

(71) Applicant: CANON KABUSHIKI KAISHA, Tokyo (JP)

(72) Inventors: Nobuyoshi Yoshida, Suntou-gun (JP); Yoshihiro Mitsui, Numazu (JP); Kodai Hayashi, Suntou-gun (JP); Yuichiro Hirata, Suntou-gun (JP); Shinya Yamamoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 12 days.

(21) Appl. No.: 13/868,829

(22) Filed: Apr. 23, 2013

(65) Prior Publication Data

US 2013/0287452 A1 Oct. 31, 2013

(30) Foreign Application Priority Data

Apr. 26, 2012 (JP) ..... 2012-100954
Apr. 26, 2012 (JP) ..... 2012-100956

(51) Int. Cl.
*G03G 15/00* (2006.01)
*G03G 21/18* (2006.01)
*G03G 15/08* (2006.01)

(52) U.S. Cl.
CPC ..... *G03G 21/1817* (2013.01); *G03G 15/0806* (2013.01); *G03G 15/0808* (2013.01)

(58) Field of Classification Search
CPC ..... G03G 21/1803; G03G 21/1817; G03G 15/0806; G03G 15/0844; G03G 15/0865
USPC ..... 399/119, 120, 254, 258, 260, 263, 264, 399/279–281, 284
See application file for complete search history.

(56) References Cited

U.S. PATENT DOCUMENTS

| | | | | |
|---|---|---|---|---|
| 6,907,215 | B2 * | 6/2005 | Yasukawa et al. | 399/281 |
| 2003/0113139 | A1 | 6/2003 | Yasukawa | |
| 2003/0231906 | A1 | 12/2003 | Yoshizawa | |
| 2008/0193171 | A1 * | 8/2008 | Adachi et al. | 399/284 |
| 2011/0188896 | A1 * | 8/2011 | Sakaya et al. | 399/263 |

FOREIGN PATENT DOCUMENTS

| | | | |
|---|---|---|---|
| JP | 2003-173083 | A | 6/2003 |
| JP | 2003-330259 | A | 11/2003 |
| JP | 2003-330267 | A | 11/2003 |
| JP | 2004-004731 | A | 1/2004 |
| JP | 2005-249883 | A | 9/2005 |
| JP | 2008-145793 | A | 6/2008 |
| JP | 2008-170895 | A | 7/2008 |
| JP | 2008-197175 | A | 8/2008 |
| JP | 2009-222931 | A | 10/2009 |

* cited by examiner

*Primary Examiner* — Walter L Lindsay, Jr.
*Assistant Examiner* — Jessica L Eley
(74) *Attorney, Agent, or Firm* — Canon USA Inc. IP Division

(57) ABSTRACT

In a development device in which a developer containing unit underlies a development chamber, a supplying member in the development chamber forms a nip portion with a developer carrier and the developer carrier and the supplying member rotate in the direction in which their respective surfaces move from an upper end to a lower end of the nip portion.

44 Claims, 14 Drawing Sheets

DEVELOPMENT DEVICE, PROCESS CARTRIDGE, AND IMAGE FORMING APPARATUS

BACKGROUND OF THE INVENTION

1. Field of the Invention

The present invention relates to an image forming apparatus for forming an image on a recording material using an electrophotographic system and, in particular, to a development device and a process cartridge applied to the image forming apparatus.

2. Description of the Related Art

In an image forming apparatus such as a printer using an electrophotographic image forming system (an electrophotographic process), an electrophotographic photosensitive member (hereinafter referred to as a "photosensitive member") acting as an image carrier is uniformly charged, and the charged photosensitive member is selectively exposed to form an electrostatic image on the photosensitive member. The electrostatic image formed on the photosensitive member is visualized as a toner image by a toner as a developer. The toner image formed on the photosensitive member is transferred to a recording paper or a recording material such as a plastic sheet and the toner image transferred to the recording material is subjected to heat and pressure to be fixed to the recording material, thereby recording an image.

In general, such an image forming apparatus requires the supply of a developer and the maintenance of various process units. For the purpose of facilitating the supplying work of the developer and the maintenance of various process units, a photosensitive member, a charging unit, a developing unit, and a cleaning unit are integrated into a frame member to form a cartridge, and thereby a process cartridge detachable from the image forming apparatus main body is put into practical use. A process cartridge system can provide an image forming apparatus excellent in usability.

In recent years, a color image forming apparatus for forming a color image using a plurality of color developers has come into wide use. As the color image forming apparatus, an inline image forming apparatus is known in which a photosensitive member corresponding to each of image forming operations using a plurality of color developers is arranged in a row along a moving direction of the surface of a member to be transferred to which the toner image is transferred. Some inline color image forming apparatuses arrange in row a plurality of photosensitive members in the direction (in the horizontal direction, for example) intersecting with the vertical direction (direction of gravity). The inline system image forming system is advantageous in that it can easily cope with demand for increasing an image forming speed and developing to a multifunction printer.

Some image forming apparatuses arrange photosensitive members under an intermediate transfer member acting as the member to be transferred or a recording material carrier conveying a recording material acting as the member to be transferred.

If the photosensitive members are arranged under the intermediate transfer member or the recording material carrier, a fixing device and a development device (or an exposure device), for example, can be arranged in a separate position with the intermediate transfer member or the recording material carrier sandwiched in the image forming apparatus main body. This brings the advantage of the development device (or the exposure device) being insusceptible to heat.

As described above, if the photosensitive members are arranged under the intermediate transfer member or the recording material carrier, a developer storage portion in the development device may need to supply a developer to a developing roller (or a developer carrier) or a supply roller (a supplying member) contrary to gravity.

Japanese Patent Application Laid-Open No. 2003-173083 discusses a method of bringing a receiving sheet into contact with the lower side of the supplying member, as a method for supplying a developer to the supplying member. According to the method, the receiving sheet prevents the developer adhering to the supplying member from falling due to gravity and prevents the developer supplied to the developer carrier from decreasing, so that lowering of the density of a solid image is prevented.

Japanese Patent Application Laid-Open No. 2009-222931 discusses a method in which a developer is conveyed to the lower surface of a supplying member by a conveyance member provided under the supplying member and the toner is inhibited from coagulating in the development chamber lying above the developer storage portion.

However, in the method of supplying the developer discussed in Japanese Patent Application Laid-Open No. 2003-173083, if an image low in a printing ratio is continuously output, the developer is retained and coagulated between the supplying member and the receiving sheet, so that image quality deterioration such as density ununiformity may occur.

In a configuration of Japanese Patent Application Laid-Open No. 2009-222931, the conveyance member needs to be added in addition to the supplying member in the development chamber to complicate the configuration of an apparatus. The friction between the developer and the conveyance member in the development chamber deteriorates the developer.

SUMMARY OF THE INVENTION

The present invention is directed to providing a development device, a process cartridge, and an image forming apparatus which are simple in configuration and capable of stably forming a high quality image in using the development device configured to convey a developer onto a supplying member arranged in a development chamber from a developer storage portion arranged under the development chamber.

According to an aspect of the present invention, a development device used in an electrophotographic image forming apparatus includes a development chamber including a developer carrier configured to carry a developer and develop an electrostatic latent image, a supplying member configured to be arranged to form a nip portion with the developer carrier and supply the developer to the developer carrier, and a regulation member configured to regulate an amount of the developer carried on the developer carrier, a containing chamber configured to be arranged under the development chamber and contain the developer, and a conveyance member configured to convey the developer contained in the containing chamber to the upper portion of the supplying member via an opening provided in the development chamber, in which the development chamber is provided with a storage portion for storing the developer through under the regulation member to under the supplying member, the supplying member is arranged so that a part or the whole thereof can be immersed in the developer in the storage portion, and the developer carrier and the supplying member rotate in the direction in which their respective surfaces move from an upper end to an lower end of the nip portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A development device, a process cartridge, and an image forming apparatus according to the present invention are described more in detail below with reference to the accompanying drawings.

Exemplary embodiments will be described below.

General Configuration of Image Forming Apparatus

A general configuration of an electrophotographic image forming apparatus (an image forming apparatus) according to the present invention is described below.

Figure 1:
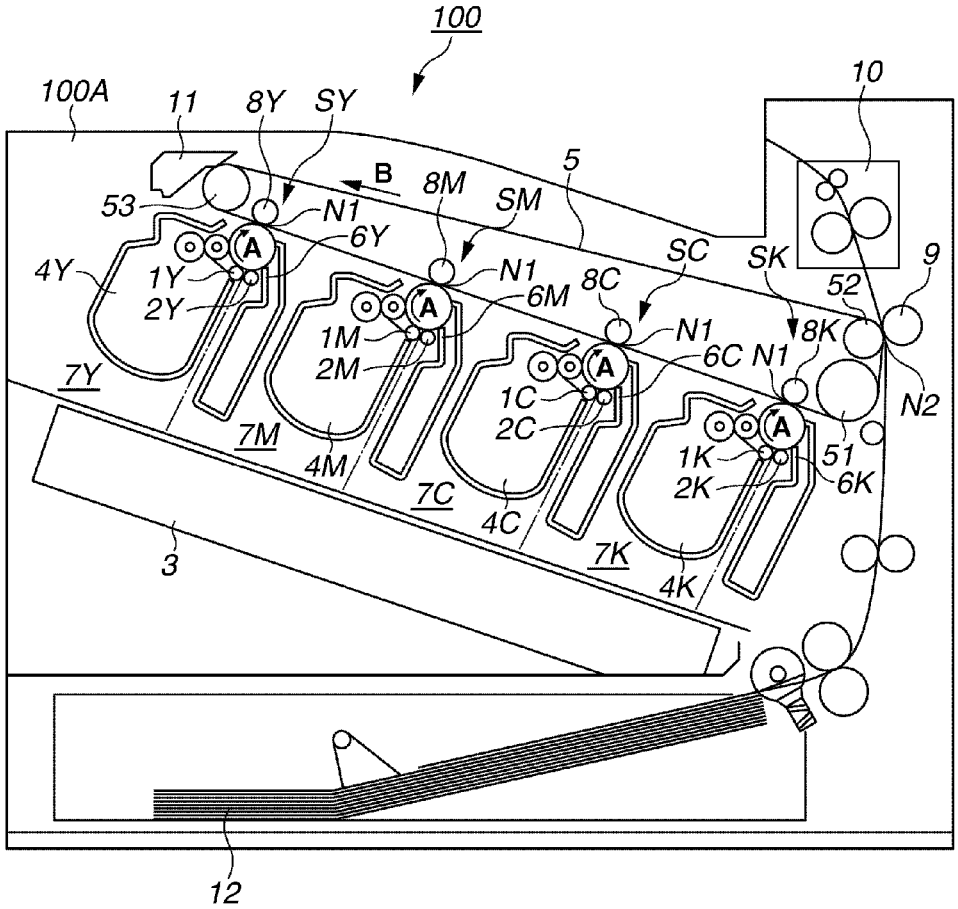
FIG. 1 illustrates a schematic cross section of an image forming apparatus according to a first a second, and a third exemplary embodiments.

FIG. 1 illustrates a schematic cross section of an image forming apparatus 100 according to the present exemplary embodiment. The image forming apparatus 100 of the present exemplary embodiment is a full-color laser printer adopting the inline system and an intermediate transfer method. The image forming apparatus 100 is capable of forming a full-color image on a recording material (recording paper, plastic sheet, and cloth, for example) according to image information. The image information is input to an image forming apparatus main body 100A from an image reading apparatus connected to the image forming apparatus main body 100A or a host apparatus such as a personal computer communicably connected to the image forming apparatus main body 100A.

The image forming apparatus 100 includes first, second, third, and fourth image forming units SY, SM, SC, and SK for forming yellow (Y), magenta (M), cyan (C) and black (K) images respectively. In the present exemplary embodiment, the first to fourth image forming units SY, SM, SC, and SK are arranged in a row in the direction intersecting with the vertical direction.

In the present exemplary embodiment, the first to fourth image forming units SY, SM, SC, and SK are substantially the same as one another in configuration and operation except that images to be formed are different in color. Hereinafter, unless discrimination is particularly required, suffixes Y, M, C, and K which are provided for reference characters to indicate elements provided for any color are omitted to make a general description.

In the present exemplary embodiment, the image forming apparatus 100 includes four-drum electrophotographic photosensitive members arranged side by side in the direction intersecting with the vertical direction acting as a plurality of image carriers, that is, a photosensitive drum 1. The photosensitive drum 1 is rotationally driven by a driving unit (a driving source) (not illustrated) in the direction (clockwise) indicated by an arrow A in the figure. Around the photosensitive drum 1 there are arranged a charging roller 2 acting as a charging unit for uniformly charging the surface of the photosensitive drum 1 and a scanner unit (an exposure device) 3 acting as an exposure unit for forming an electrostatic image (an electrostatic latent image) on the photosensitive drum 1 by irradiating the photosensitive drum 1 with laser beams based on image information. Furthermore, around the photosensitive drum 1 there are arranged a development unit (a development device) 4 for developing an electrostatic image as a toner image and a cleaning member 6 acting as a cleaning unit for removing a toner (transfer residual toner) remaining on the surface of the photosensitive drum 1 after transfer. Still furthermore, an intermediate transfer belt 5 as an intermediate transfer member for transferring the toner image on the photosensitive drum 1 to a recoding material 12 is arranged being opposed to the four photosensitive drums 1.

In the present exemplary embodiment, the development unit 4 uses a toner of a non-magnetic one-component developer as a developer. In the present exemplary embodiment, the development unit 4 performs a reversal development by bringing a development roller (described below) as a developer carrier into contact with the photosensitive drum 1. More specifically, in the present exemplary embodiment, the development unit 4 develops an electrostatic image such that the toner charged with the same polarity (a negative polarity in the present exemplary embodiment) as the photosensitive drum 1 is caused to adhere to a portion (an image unit and an exposure unit) on the photosensitive drum 1 where charges are attenuated due to exposure.

In the present exemplary embodiment, the photosensitive drum 1 and the charging roller 2, the development unit 4, and the cleaning member 6 as process units acting on the photosensitive drum 1 are integrated, in other words, integrated into a cartridge to form a process cartridge 7. The process cartridge 7 is detachable from the image forming apparatus 100 via a mounting unit such as a mounting guide and a positioning member provided on the image forming apparatus main body 100A. In the present exemplary embodiment, all the process cartridges 7 for each color are similar in shape and respectively include respective color toners of yellow (Y), magenta (M), cyan (C), and black (K).

The intermediate transfer belt 5 formed of an endless belt as an intermediate transfer member abuts on all the photosensitive drums 1 and is cyclically moved (rotated) in the direction (counterclockwise) indicated by an arrow B in the figure. The intermediate transfer belt 5 is stretched between a drive roller 51, a secondary transfer counter roller 52, and a driven roller 53 which are a plurality of supporting members.

Four primary transfer rollers 8 as primary transfer units are arranged side by side opposed to the photosensitive drums 1 on an inner circumferential surface side of the intermediate transfer belt 5. The primary transfer roller 8 presses the intermediate transfer belt 5 against the photosensitive drum 1 to form a primary transfer portion N1 where the intermediate transfer belt 5 abuts on the photosensitive drum 1. A primary transfer bias power source (a high voltage power source) as a primary transfer bias application unit (not illustrated) applies bias with a polarity reverse to a normal charging polarity of the toner to the primary transfer roller 8. Thereby, the toner image on the photosensitive drum 1 is transferred (primary transfer) to the intermediate transfer belt 5.

A secondary transfer roller 9 as a secondary transfer unit is arranged in a position opposing to the secondary transfer counter roller 52 on an outer circumferential surface side of the intermediate transfer belt 5. The secondary transfer roller 9 is pressed against the secondary transfer counter roller 52 via the intermediate transfer belt 5 to form a secondary transfer portion N2 where the intermediate transfer belt 5 abuts on the secondary transfer roller 9. A secondary transfer bias power source (a high voltage power source) as a secondary transfer bias application unit (not illustrated) applies bias with a polarity reverse to a normal charging polarity of the toner to the secondary transfer roller 9. Thereby, the toner image on the intermediate transfer belt 5 is transferred (secondary transfer) to the recoding material 12.

When an image is formed, the surface of the photosensitive drum 1 is uniformly charged by the charging roller 2. The charged surface of the photosensitive drum 1 is scanned and exposed with laser beams emitted from the scanner unit 3 according to image information to form an electrostatic image on the photosensitive drum 1 according to the image information. The electrostatic image formed on the photosensitive drum 1 is developed as a toner image by the development unit 4. The toner image formed on the photosensitive drum 1 is transferred (primary transfer) to the intermediate transfer belt 5 by the action of the primary transfer roller 8.

When a full-color image is formed for example, the above process is sequentially carried out in the first to fourth image forming units SY, SM, SC, and SK to sequentially superimpose toner images of each color on the intermediate transfer belt 5, performing the primary transfer.

Thereafter, the recoding material 12 is conveyed to the secondary transfer portion N2 in synchronization with the movement of the intermediate transfer belt 5. The four color toner images on the intermediate transfer belt 5 are collectively secondary-transferred onto the recoding material 12 by the action of the secondary transfer roller 9 abutting on the intermediate transfer belt 5 via the recoding material 12.

The recoding material 12 onto which the toner image is transferred is conveyed to a fixing device 10 as a fixing unit. In the fixing unit, the recoding material 12 is subjected to heat and pressure to fix the toner image to the recoding material 12.

A primary transfer residual toner remaining on the photosensitive drum 1 after the primary transfer processing is removed and collected by the cleaning member 6. A secondary transfer residual toner remaining on the intermediate transfer belt 5 after the secondary transfer processing is cleaned by an intermediate transfer belt cleaning device 11.

The image forming apparatus 100 is capable of forming a monochrome or multi-color image using only one desired image forming unit or some image forming units (not all units).

Configuration of Process Cartridge

The general configuration of the process cartridge 7 attached to the image forming apparatus 100 according to the present exemplary embodiment is described below. In the present exemplary embodiment, the process cartridges 7 for each color are substantially the same as one another in configuration and operation except the type (color) of the stored toner.

Figure 2:
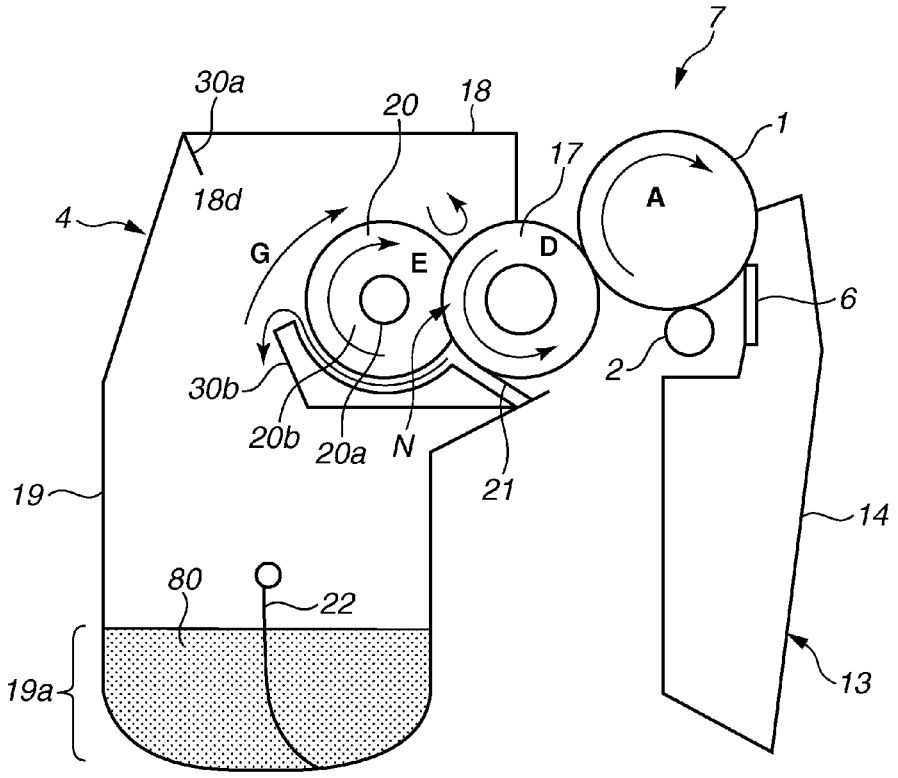
FIG. 2 is a schematic cross section of a process cartridge according to the first exemplary embodiment.

FIG. 2 is a schematic cross section (a principal section) of the process cartridge 7 according to the present exemplary embodiment, when viewed along the longitudinal direction of the photosensitive drum 1 (in the direction of a rotational axis line). FIG. 2 illustrates an orientation in which the process cartridge 7 is attached to the image forming apparatus main body. When the positional relation and direction of members of the process cartridge 7 are described below, the positional relation and direction in this orientation are indicated.

The process cartridge 7 is formed by integrating a photosensitive unit 13 equipped with the photosensitive drum 1 and a development unit 4 equipped with a development roller 17.

The photosensitive unit 13 includes a cleaning frame member 14 as a frame member for supporting various types of elements inside the photosensitive unit 13. The photosensitive drum 1 is rotatably attached to the cleaning frame member 14 via a bearing (not illustrated). A driving force of a drive motor (not illustrated) as a driving unit (a driving source) is transmitted to the photosensitive unit 13 to rotationally drive the photosensitive drum 1 in the direction (clockwise) indicated by the arrow A in the figure according to an image forming operation. In the present exemplary embodiment, the photosensitive drum 1 centering an image forming process uses an organic photosensitive drum 1 in which an under coat layer of functional film, a carrier generation layer, and a carrier transfer layer are coated one on top of another on the outer circumferential surface of an aluminium cylinder.

On the photosensitive unit 13, a cleaning member 6 and a charging roller 2 are arranged to be brought into contact with the circumferential surface of the photosensitive drum 1. The transfer residual toner removed from the surface of the photosensitive drum 1 by the cleaning member 6 falls in the cleaning frame member 14 and is collected.

The charging roller 2 being the charging unit brings a conductive rubber roller portion into press contact with the photosensitive drum 1 to be rotatably driven.

A predetermined direct-current voltage with respect to the photosensitive drum 1 is applied to a metal core of the charging roller, as a charging process, so that a uniform dark portion potential (Vd) is formed on the surface of the photosensitive drum 1. The spot pattern of the laser beam emitted from the scanner unit 3 according to image data exposes the photosensitive drum 1. Charges on the surface of the exposed region disappear due to carriers from the carrier generation layer to lower potential. As a result, an electrostatic latent image of a predetermined light portion potential (V1) is formed in the exposed region on the photosensitive drum 1 and an electrostatic latent image of a predetermined dark portion potential (Vd) is formed in a non-exposed region thereon. In the present exemplary embodiment, Vd=−500V and V1=−100V.

The development unit 4 includes a development roller 17 as a developer carrier for carrying a toner 80 and a development chamber 18 in which a supply roller 20 as a supply member for supplying toner to the development roller 17 is arranged. The development unit 4 further includes a toner containing chamber 19 with a toner containing unit (a developer containing unit) 19*a* for containing toner, arranged under the supply roller 20 in the gravity direction. In the present exemplary embodiment, toner with a coagulation degree of 5 to 40% in an initial state is used. It is desirable to use toner with such a coagulation degree to ensure the liquidity of the toner throughout usage. The coagulation degree of the toner was measured by the following method.

The measuring device used is a powder tester (manufactured by Hosokawa Micron Ltd.) including a digital vibration meter model 1332 manufactured by Showa Sokki Corporation.

As a measuring method, a 390 mesh, 200 mesh, and 100 mesh sieves are stacked one on top of another on a vibrating table in the ascending order of a sieve opening so that the 100 mesh sieve is stacked on the top.

An accurately weighed sample (toner) of 5 g was put on the 100 mesh sieve, the value of variation of the digital vibration meter was set to 0.60 mm (peak-to-peak), and vibration was applied thereto for 15 seconds. Thereafter, the mass of the sample remaining on each sieve was measured to obtain a coagulation degree based on the following equation.

The measurement samples were previously left under an environment of 23° C. and 60% RH for 24 hours. The measurement was conducted under an environment of 23° C. and 60% RH.

Coagulation degree(%)=(mass of a sample remaining on 100 mesh sieve/5 g)×100+(mass of a sample remaining on 200 mesh sieve/5 g)×60+(mass of a sample remaining on 390 mesh sieve/5 g)×20.

The supply roller 20 forms a nip portion N of toner between the supply roller 20 and the development roller 17 (a portion where toner is sandwiched between the supply roller 20 and the development roller 17) and is rotated.

A toner conveyance member 22 is provided inside the toner containing chamber 19. The toner conveyance member 22 stirs the toner contained in the toner containing chamber 19 and conveys the toner in the direction indicated by an arrow G in the figure upward to the supply roller 20. In the present exemplary embodiment, the toner conveyance member 22 drives to rotate at 30 rpm.

A development blade 21 as a regulation member for regulating the amount of the developer on the development roller 17 is arranged under the development roller 17 and abuts on the lower side of the development roller 17 in a counter direction to regulate the amount of coat of the toner supplied by the supply roller 20 and apply charges. In the present exemplary embodiment, a thin plate of 0.1 mm thick flat spring of SUS stainless steel is used as the development blade 21. The elasticity of spring of the thin plate is used to form an abutting pressure and the surface thereof is caused to abut on the toner and the development roller 17. The development blade 21 is not limited to the above thin plate, but a metallic thin plate of phosphor bronze or aluminum may be used. Alternatively, there may be used a blade in which the surface of the development blade 21 is coated with thin film such as polyamide elastomer, urethane rubber, or urethane resin.

The toner is charged by friction between the development blade 21 and the development roller 17, so that charges are applied and layer thickness is regulated. In the present exemplary embodiment, a predetermined voltage is applied from a blade bias power source (not illustrated) to the development blade 21 to stabilize a toner coat. In the present exemplary embodiment, V=−500 V was applied as a blade bias.

The development roller 17 and the photosensitive drum 1 rotate so that each surface thereof is moved in the same direction (upward direction in the present exemplary embodiment) at a counter portion.

In the present exemplary embodiment, the development roller 17 is arranged in contact with the photosensitive drum 1, however, the development roller 17 may be arranged in the vicinity of the photosensitive drum 1 at a predetermined spaced intervals.

In the present exemplary embodiment, the toner charged to negative due to frictional charge with respect to the predetermined direct current (DC) bias applied to the development roller 17 is transferred only to the light portion potential portion owing to the difference in potential at a development portion coming into contact with the photosensitive drum 1 to visualize the electrostatic latent image. In the present exemplary embodiment, V=−300 V is applied to the development roller 17 to form a difference in potential with the light portion potential portion ΔV=200 V, forming a toner image.

The supply roller 20 and the development roller 17 rotate in the direction in which each surface thereof is moved from the upper end to the lower end of the nip portion N. More specifically, the supply roller 20 rotates in the direction (clockwise) indicated by an arrow E in the figure and the development roller 17 rotates in the direction indicated by an arrow D in the figure. The supply roller 20 is an elastic sponge roller in which a foam layer is formed at the outer circumference of a conductive metal core thereof. The supply roller 20 and the development roller 17 are brought into contact with each other with the amount of a predetermined intrusion, i.e., the amount of concave ΔE in which the supply roller 20 is concaved by the development roller 17 in FIG. 3. Both the supply roller 20 and the development roller 17 rotate in the same direction at the nip portion N with a difference in peripheral velocity. The supply roller 20 supplies the toner to the development roller 17 by the operation. In this case, a difference in potential between the supply roller 20 and the development roller 17 is adjusted to allow the supply roller 20 to adjust the amount of supply of the toner to the development roller 17. In the present exemplary embodiment, the supply roller 20 drove to rotate at 200 rpm and the development roller 17 drove to rotate at 100 rpm. A DC bias was applied to the supply roller 20 so that the supply roller 20 becomes equal in potential to the development roller 17.

In the present exemplary embodiment, both the supply roller 20 and the development roller 17 are 15 mm in outside diameter. The amount of intrusion of the supply roller 20 into the development roller 17, that is, the amount of concave ΔE in which the supply roller 20 is concaved by the development roller 17 was set to 1.0 mm. The supply roller 20 and the development roller 17 were arranged so that the central heights thereof became equal to each other.

The supply roller 20 used in the present exemplary embodiment is described in detail below. The supply roller 20 in the present exemplary embodiment includes a conductive supporting member and a foam layer supported by the conductive supporting member. More specifically, a foam urethane layer 20*b* as a foam layer formed of an open-cell foam in which foams are connected to each other is provided around a metal core electrode 20*a* being the conductive supporting member with an outside diameter ϕ of 5 mm. The supply roller 20 rotates in the direction indicated by the arrow E in the figure.

The open-cell foam is used in the urethane surface-layer to allow a large amount of the toner to enter the supply roller 20. In the present exemplary embodiment, the supply roller 20 has a resistance of $1\times10^{9}\Omega$.

A method for measuring a resistance of the supply roller 20 is described below. The supply roller 20 is caused to abut on an aluminum sleeve with a diameter of 30 mm to such an extent that the amount of intrusion described below reaches 1.5 mm. The aluminum sleeve is rotated to cause the supply roller 20 to be rotationally driven at 30 rpm with respect to the aluminum sleeve.

A DC voltage of −50 V is applied to the development roller 17. In this case, a resistor of 10 kΩ is provided on the ground side and a voltage at both ends thereof is measured to calculate a current, calculating the resistance of the supply roller 20. In the present exemplary embodiment, a surface cell diameter of the supply roller 20 was taken as 50 μm to 1000 μm.

The cell diameter refers to an average diameter of any section of a foam-cell. The maximum foam-cell area is measured from an enlarged image of any section and a diameter corresponding to complete round is converted from the area to obtain the maximum cell diameter. The cell diameter refers to an average value of diameters of individual cells converted from the other individual cell areas in the same manner after the foam-cell whose diameter is equal to or smaller than ½ of the maximum cell diameter is deleted as noise.

Figure 3:
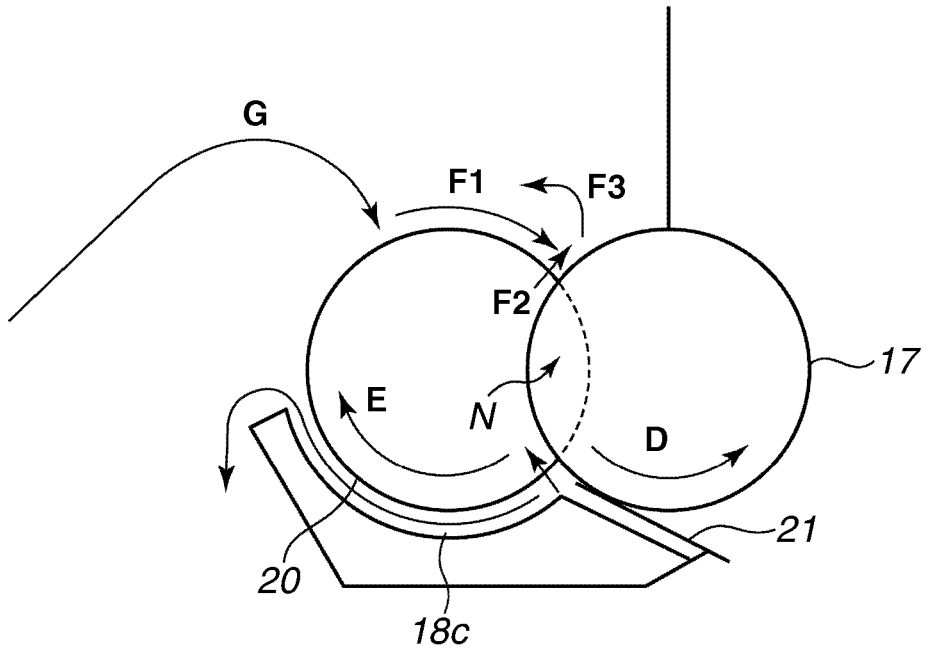
FIG. 3 illustrates motion of a toner in a development device according to the first exemplary embodiment.

The flow of the toner inside the development chamber 18 is described below with reference to FIGS. 2 and 3. In the present exemplary embodiment, FIG. 3 is an enlarged schematic sectional view of the development chamber 18 and illustrates the movement of the toner conveyed from the toner conveyance member 22 to the supply roller 20.

The toner conveyance member 22 supplies the toner mainly to the upper portion of the supply roller 20 (indicated by an arrow G in FIG. 3) in the development chamber 18. The supplied toner is held inside the supply roller 20 and the surface thereof. Since the supply roller 20 rotates in the direction indicated by the arrow E, the toner held by the supply roller 20 is conveyed toward the nip portion N between the supply roller 20 and the development roller 17 (an arrow F1 in FIG. 3). A part of the toner conveyed by the supply roller 20 is discharged by the deformation of the supply roller 20 at the entrance of the nip portion N, accumulated at the upper portion of the nip portion N, and stored therein (an arrow F2 in FIG. 3). The storage of the toner at the upper portion of the nip portion N allows the stored toner to be stably supplied to the supply roller 20 and the development roller 17 without decreasing the amount of the toner in the supply roller 20 during the period after the toner conveyance member 22 conveys the toner to the development chamber 18 until the toner conveyance member 22 conveys the toner in the next place.

Since the supply roller 20 and the development roller 17 rotate with a difference in peripheral velocity, the toner conveyed to the nip portion N is rubbed in the nip to be charged and provided with predetermined charges. Thereafter, a part of the charged toner is transferred to the development roller 17. In the present exemplary embodiment, the supply roller 20 is faster in peripheral velocity than the development roller 17, so that the amount of the toner passing on the development roller 17 per unit time increases to transfer a larger amount of toner to the development roller 17. The toner transferred to the development roller 17 is regulated and charged by the development blade 21 at a regulation portion between the development roller 17 and the development blade 21 and a uniform toner coat is formed on the development roller 17 by the toner passing the regulation portion.

The toner regulated by the development blade 21 is conveyed to a development opening (an opening portion) provided in the development chamber 18 by the rotation of the supply roller 20 and returned to the toner containing chamber 19 through the development opening. In the present exemplary embodiment, the upper end of a wall 30*b* (i.e., the lower end of the development opening) under the development opening separating the development chamber 18 from the toner containing chamber 19 is arranged by 1 mm under the center of the supply roller 20 and a gap between a frame member forming the bottom of the development chamber 18 and the lower surface of the supply roller 20 is set to 1.5 mm.

Figure 4:
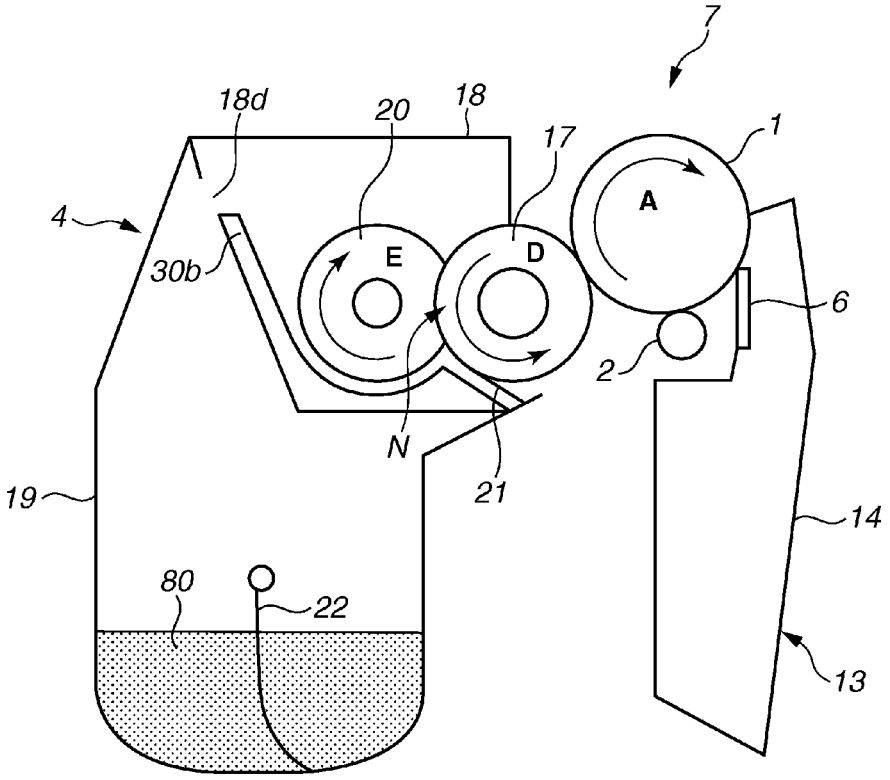
FIG. 4 illustrates another example of a configuration of the development device according to the first exemplary embodiment.

As described above, the supply of the toner to the supply roller 20 is performed by the toner conveyance member 22 sending the toner to the upper portion of the supply roller 20 through the development opening. Further, also the toner returned from the development chamber 18 to the toner containing chamber 19 by the rotation of the supply roller 20 passes through the development opening. Therefore, the configuration of the development opening influences the flow of the toner between the development chamber 18 and the toner containing chamber 19 and, in particular, a position of the upper end of the wall 30*b* under the development opening (or a position of lower end of the development opening) influences the flow thereof. More specifically, the position of the upper end of the wall 30*b* under the development opening (the position of lower end of the development opening) is made lower than the upper end of the supply roller 20, as illustrated in FIG. 2, to make the toner conveyed by the supply roller 20 to the development opening easier to leap over the wall than a case where the position of the upper end of the wall 30*b* under the development opening (the position of lower end of the development opening) is made higher than the upper end of the supply roller 20 as illustrated in FIG. 4. This makes the toner in the development chamber 18 easier to return to the toner containing chamber 19. The toner is circulated in good condition between the development chamber 18 and the toner containing chamber 19 to inhibit the degradation of the toner and inhibit the coagulation thereof even if an image with a low printing ratio is continuously output, which enables a high quality image to be stably output. In the present exemplary embodiment, the wall 30*b* is made lower in height than the rotation center portion of the supply roller 20 so that the toner is supplied in good condition by the toner conveyance member 22 onto the supply roller 20 (onto the supply member).

In the configuration of the present exemplary embodiment, a gap between the frame member forming the bottom of the development chamber 18 and the lower surface of the supply roller 20 was set to 1.5 mm. It is desirable that the gap is set to equal to or less than 5.0 mm to sufficiently convey the toner under the supply roller 20 by the rotation of the supply roller 20.

In the present exemplary embodiment, a driving input to the development unit is a single. The development roller 17, the supply roller 20, and the toner conveyance member 22 are coupled to one another by a gear (not illustrated) and driven at the same time in forming an image. Thereby, the toner conveyance member 22 supplies the toner while the supply roller 20 is being driven to rotate to accelerate the circulation of the toner between the development chamber 18 and the toner containing chamber 19.

Thus, the configuration of the present exemplary embodiment not only enables the toner to be stably supplied to the development roller 17 but also smooth toner circulation from the toner containing chamber 19 to the development chamber 18 and from the development chamber 18 to the toner containing chamber 19 is realized.

As described above, in the present exemplary embodiment, the toner conveyed by the toner conveyance member 22 can be effectively supplied to the nip portion between the supply roller 20 and the development roller 17 by the driving to rotate of the supply roller 20. The toner lying in an area under the development roller 17 and the supply roller 20 in the development chamber 18 (mainly, the toner falling by the regulation of the development blade 21) is also returned to the toner containing chamber 19 through the development opening by the rotational drive of the supply roller 20. For this reason, there are provided the development device, the process cartridge, and the image forming apparatus capable of inhibiting the degradation of the toner, stabilizing the density of a solid image, and supplying a high quality image.

A First Comparison Example

Figure 5A:
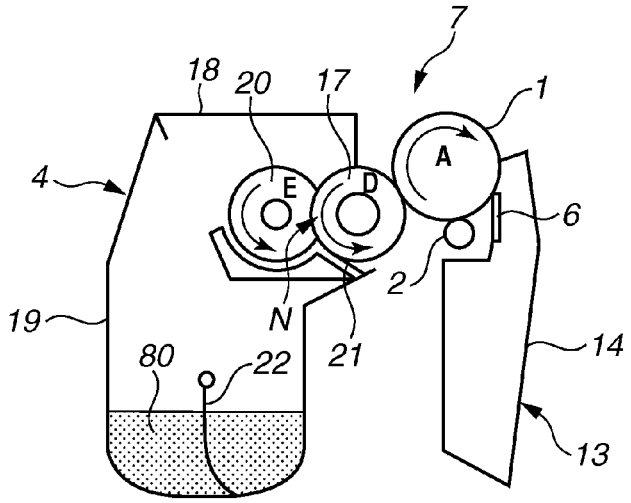
FIGS. 5A, 5B, and 5C are schematic cross sections of process cartridges according to comparison examples.

The first comparison example uses a process cartridge having a configuration illustrated in FIG. 5A. The supply roller 20 illustrated in FIG. 5A rotates reversely to that in the first exemplary embodiment. The supply roller 20 rotates at 100 rpm. The configuration of the process cartridge other than those above and the general configuration of the image forming apparatus are similar to those in the first exemplary embodiment.

A Second Comparison Example

Figure 5B:
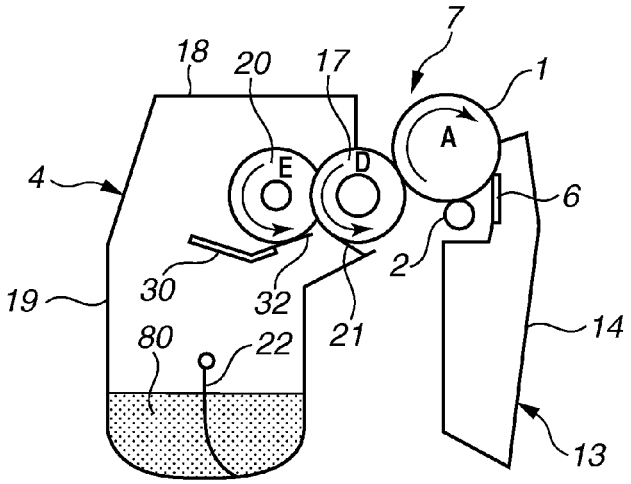

The second comparison example uses a process cartridge having a configuration illustrated in FIG. 5B. In the second comparison example, as described in the above "Related Art" (Japanese Patent Application Laid-Open No. 2003-173083), the supply roller 20 rotates reversely to that in the first exemplary embodiment. A toner receiving member 30 is provided under the supply roller 20, one end of a receiving sheet 32 is attached to the toner receiving member 30, and the receiving sheet 32 is brought into contact with the lower portion of the supply member under an appropriate line pressure.

A Third Comparison Example

Figure 5C:
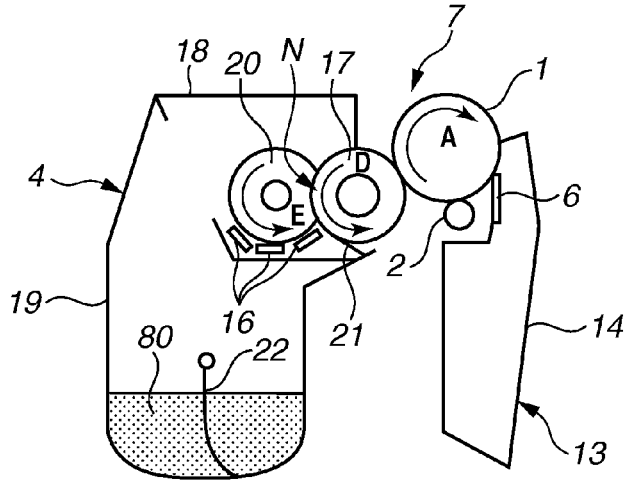

In the third comparison example, as described in the above "Related Art" (Japanese Patent Application Laid-Open No. 2009-222931), a stirring conveyance member 16 is arranged under the supply member in the configuration thereof (refer to FIG. 5C). The stirring conveyance member 16 is rotated at 200 rpm to supply the toner to the supply roller 20. The configuration of the process cartridge other than those above and the general configuration of the image forming apparatus are similar to those in the first comparison example.

Experiment

The following three experiments were conducted with respect to the above configuration of the exemplary embodiment and the comparison examples.

(1) Density Stability Evaluation of Solid Image

Amount of decrease in image density at the time of continuing print with a high printing ratio was measured to evaluate the density stability of an solid image. The evaluation was made after 100 sheets were printed after the image forming apparatus was left under an evaluation environment of 25.0° C. and 50% Rh for one day to be adapted to the environment. The 100-sheet print test was conducted such that a horizontal-line recorded image with an image ratio of 5% was continuously printed. Thereafter, three solid images were continuously output and the following evaluation was conducted based on a difference in density between the leading and trailing edges of output of the third solid image using a spectro densitometer 500 manufactured by X-Rite. The print test and the evaluation image were output in a monochrome (black).

A: a difference in density between the leading and trailing edges of paper with the solid image is less than 0.2

B: a difference in density between the leading and trailing edges of paper with the solid image is 0.2 to less than 0.3

C: a difference in density between the leading and trailing edges of paper with the solid image is equal to or more than 0.3

(2) Existence or Non-Existence of Toner Coagulation

The toner was evaluated such that the image forming apparatus whose endurance test ended was disassembled to check whether the toner was coagulated in the development chamber 18.

A: the toner coagulation exists

B: the toner coagulation occurs

The endurance test was conducted such that vertical lines with an image ratio of 1% were intermittently printed on 10000 pieces of papers under an environment of 32.5° C. and 80% Rh. The intermittent printing means that the following print is performed after the elapse of a standby state after printing.

"The toner coagulation occurs" indicates a state where the toner is squeezed under the development roller and the supply roller and coagulated. If image is formed in a state of occurrence of the toner coagulation, degradation of image quality such as density ununiformity occurs.

(3) Existence or Non-Existence of Toner Fusion to Development Roller

Evaluation of the toner fusion to the development roller was performed such that the development roller of the image forming apparatus whose endurance test ended was observed to check if the toner is fused.

A: the toner fusion does not exist

B: the toner fusion slightly exists (the development roller is slightly whitened)

C: the toner fusion exists (the development roller is polluted in color)

The condition for the endurance test was similar to that for (2) an evaluation of the toner coagulation.

EXPERIMENT RESULTS

Setting and evaluation results of the exemplary embodiment and the comparison examples are given in a table 1 illustrated below.

TABLE 1

| | Evaluation items | | |
|---|---|---|---|
| | (1) Density stability of solid image | (2) Existence of non-existence of toner coagulation | (3) Existence of non-existence of toner fusion |
| First exemplary embodiment | A | A | A |

TABLE 1-continued

| | Evaluation items | | |
|---|---|---|---|
| | (1) Density stability of solid image | (2) Existence of non-existence of toner coagulation | (3) Existence of non-existence of toner fusion |
| First comparison example | C | B | C |
| Second comparison example | C | A | A |
| Third comparison example | A | A | B |

The results of the first comparison example are described below. In the first comparison example, the supply roller rotates counterclockwise. In the configuration of the first comparison example, the great majority of the toner supplied on the supply roller is returned to the toner containing chamber 19 from the development opening by the rotation of the supply roller without being supplied to the vicinity of the development roller. Therefore, it is difficult to ensure the density stability of the solid image.

An image low in a printing ratio was continuously output to squeeze and coagulate the toner in the lower area of the supply roller and the development roller in the development chamber 18. The toner inside the development chamber 18 does not behave in a manner of returning to the toner containing chamber 19, so that the toner in the vicinity of the development blade is locally deteriorated to be fused to the development roller.

The results of the second comparison example are described below. In the configuration of the second comparison example, the toner receiving member is provided under the supply roller, so that the toner conveyed by the supply roller is stably supplied without falling into the toner containing chamber 19 and only the toner regulated by the development blade falls into the toner containing chamber 19. Therefore, the density stability of the solid image can be ensured to preclude the toner from fusing and coagulating to the development roller in the vicinity of the development blade. However, the toner receiving member is brought into contact with the supply roller to coagulate the toner between a toner supplying member and the toner receiving member, causing an image density ununiformity attributable to the toner coagulation.

The results of the third comparison example are described below. In the third comparison example, the toner conveyance member is provided under the supply roller inside the development chamber 18 with respect to the configuration of the first comparison example. The toner conveyance member is provided to inhibit the toner from coagulating in the area under the supply roller and the development roller inside the development chamber 18 and return the toner under the toner conveyance member to the toner containing chamber 19. Therefore, the density ununiformity attributable to the toner coagulation does not occur. Coagulation and degradation in the toner is accelerated by a friction between the toner and the toner conveyance member, so that the toner was fused to the development roller when an image low in a printing ratio was continuously output. The apparatus is complicated in configuration because the toner conveyance member needs to be added other than the supply roller inside the development chamber 18.

The results of the present exemplary embodiment are described below. In the present exemplary embodiment, the supply roller rotates clockwise in FIG. 2, so that the toner supplied on the supply roller is accumulated on the upper part of the nip portion between the supply roller and the development roller to form a toner bank. This allows the toner to be stably supplied to the development roller and the density stability of the solid image to be ensured. Since the toner lying in the area under the supply roller and the development roller inside the development chamber 18 is returned to the toner containing chamber 19 by the rotation of the supply roller, neither the coagulation nor the local degradation of the toner occurs. The above evaluation results can be achieved by the apparatus simple in configuration without the need for providing a conveyance member for conveying the toner to the toner supplying member in the development chamber 18. In other words, a simple configuration forms a good circulation of the developer to enable stable forming of a high quality image.

The present exemplary embodiment exemplifies the image forming apparatus capable of forming a color image, however, the present invention is not limited to the present exemplary embodiment. Even the image forming apparatus capable of forming a monochrome image can obtain the similar effect.

The present exemplary embodiment exemplifies the printer as the image forming apparatus, however, the present invention is not limited to the present exemplary embodiment. Even other image forming apparatuses such as a copying machine and facsimile machine, for example, other image forming apparatuses such as a multifunction peripheral in which these functions are combined, or an image forming apparatus in which a recording material carrier is used and toner images of each color are sequentially superimposes onto a recording material carried by the recording material carrier to perform transfer can obtain the similar effect.

A second exemplary embodiment will be described below. A general configuration of an electrophotographic image forming apparatus (an image forming apparatus) according to the second exemplary embodiment is basically similar to that of the first exemplary embodiment (refer to FIG. 1). The process cartridge of the present exemplary embodiment is provided with configuration for optically detecting the remaining toner amount. Setting a desirable relationship between the direction of rotation of the supply roller and the configuration of the remaining toner amount enables improving the accuracy in the detection of remaining toner amount. A process cartridge 7 of the present exemplary embodiment is described below.

Process Cartridge

Figure 6:
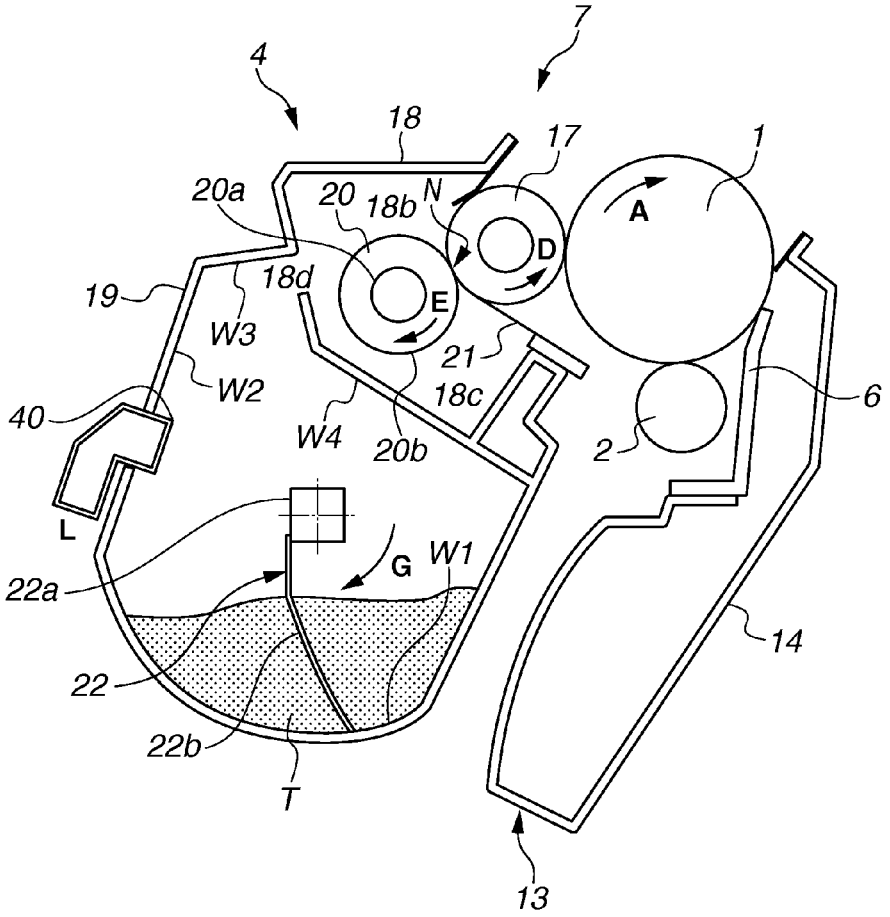
FIG. 6 is a schematic cross section of the development device and the process cartridge according to the first exemplary embodiment.

FIG. 6 is a schematic cross section (a principal section) of the process cartridge 7 according to the present exemplary embodiment, when viewed along the longitudinal direction of the photosensitive drum 1 (in the direction of a rotational axis line). FIG. 6 illustrates an orientation in which the process cartridge 7 is attached to the image forming apparatus main body. When the positional relation and direction of members of the process cartridge 7 are described below, the positional relation and direction in this orientation are indicated. In the present exemplary embodiment, the process cartridges 7 for each color are substantially the same as one another in configuration and operation except the type (color) of the stored developer.

The process cartridge 7 is formed by integrating a photosensitive unit 13 equipped with the photosensitive drum 1 and a development unit 4 equipped with a development roller 17.

The photosensitive unit 13 includes a cleaning frame member 14 as a frame member for supporting various types of elements inside the photosensitive unit 13. The photosensitive drum 1 is rotatably attached to the cleaning frame member 14 via a bearing (not illustrated).

A driving force of a drive motor (not illustrated) as a driving unit (a driving source) is transmitted to the photosensitive unit 13 to rotationally drive the photosensitive drum 1 in the direction (clockwise) indicated by the arrow A in the figure according to an image forming operation. In the present exemplary embodiment, the photosensitive drum 1 centering an image forming process uses an organic photosensitive drum 1 in which an under coat layer of functional film, a carrier generation layer, and a carrier transfer layer are coated one on top of another on the outer circumferential surface of an aluminium cylinder.

On the photosensitive unit 13, a cleaning member 6 and a charging roller 2 are arranged to be brought into contact with the circumferential surface of the photosensitive drum 1. The transfer residual toner removed from the surface of the photosensitive drum 1 by the cleaning member 6 falls in the cleaning frame member 14 and is collected.

The charging roller 2 being the charging unit brings a conductive rubber roller portion into press contact with the photosensitive drum 1 to be rotatably driven.

A predetermined direct-current voltage with respect to the photosensitive drum 1 is applied to a metal core of the charging roller, as a charging process, so that a uniform dark portion potential (Vd) is formed on the surface of the photosensitive drum 1. The spot pattern of the laser beam emitted from the scanner unit 3 according to image data exposes the photosensitive drum 1. Charges on the surface of the exposed region disappear due to carriers from the carrier generation layer to lower potential. As a result, an electrostatic latent image of a predetermined light portion potential (V1) is formed in the exposed region on the photosensitive drum 1 and an electrostatic latent image of a predetermined dark portion potential (Vd) is formed in a non-exposed region thereon.

The development unit 4 includes a development roller 17 as a developer carrier for carrying a toner 80 and a supply roller 20 as a development supply member for supplying toner to the development roller 17. The development unit 4 further includes a developer containing chamber, i.e., a toner containing chamber 19 which is arranged under the supply roller 20 in the gravity direction and contains a toner 80. The development unit 4 still further includes a development chamber 18 inside which a development roller 17 and a supply roller 20 are provided. The development chamber 18 has an opening 18*d* for feeding the toner from the toner containing chamber 19.

The toner containing chamber 19 includes a toner conveyance member 22 which is rotatably supported by the toner containing chamber 19, stirs the contained toner, and conveys the toner to the upper portion of the supply roller 20 (supply member).

The toner containing chamber 19 includes a bottom wall surface W1 and a first wall surface W2 which is connected with the bottom wall surface W1 and tilted inward to the toner containing chamber 19 along a rotating direction G of the toner conveyance member 22 in a state that the toner containing chamber 19 is attached to the cartridge, i.e., with the orientation illustrated in FIG. 6.

The toner containing chamber 19 further includes a second wall surface W3 which is connected with the first wall surface W2 and reaches the opening 18*d* and a third wall surface W4 extending from the second wall surface W3 to the bottom wall surface W1.

As described in detail below, the leading edge of the toner conveyance member 22 moves in contact with the bottom wall surface W1 and the first wall surface W2 in the toner containing chamber 19. For this reason, the toner in the toner containing chamber 19 is lifted and conveyed from the bottom wall surface W1 to the first wall surface W2 and guided to the upper portion of the supply roller 20 along a second wall surface W3.

The toner sent to the upper portion of the supply roller 20 is accumulated in a second storage portion 18*b* in an area above a nip portion N between the development roller 17 and the supply roller 20 (a portion where the toner is sandwiched between the development roller 17 and the supply roller 20).

A toner T which is not guided to the upper portion of the supply roller 20 falls into the toner containing chamber 19 or is guided to the toner containing chamber 19 along a third wall surface W4. In the present exemplary embodiment, the development unit 4 is 230 mm in a longitudinal width.

The supply roller 20 and the development roller 17 are in contact with each other at the nip portion N and rotate so that their respective surfaces move in the same direction (in the direction from the upper end to the lower end of the nip portion in the present exemplary embodiment).

A development blade 21 abuts on the development roller 17 in a counter direction to regulate the amount of coat of the toner supplied by the supply roller 20 and apply charges. The development blade 21 is formed of a thin plate member and uses the elasticity of spring of the thin plate member to form an abutting pressure. The surface of the development blade 21 is brought into contact with the toner and the development roller 17. The toner is charged by friction between the development blade 21 and the development roller 17, so that charges are applied and layer thickness is regulated. In the present exemplary embodiment, a predetermined voltage is applied from a blade bias power source (not illustrated) to the development blade 21 to stabilize a toner coat.

The development roller 17 and the photosensitive drum 1 rotate so that each surface thereof is moved in the same direction (upward direction in the present exemplary embodiment) at a counter portion (a contact portion).

In the present exemplary embodiment, the development roller 17 is arranged in contact with the photosensitive drum 1, however, the development roller 17 may be arranged in the vicinity of the photosensitive drum 1 at a predetermined spaced intervals.

In the present exemplary embodiment, the toner charged to negative due to frictional charge with respect to the predetermined direct current (DC) bias applied to the development roller 17 is transferred only to the light portion potential portion owing to the difference in potential at a development portion coming into contact with the photosensitive drum 1 to visualize the electrostatic latent image.

The supply roller 20 is arranged to form a predetermined contact portion (the nip portion) N on the circumferential surface of the development roller 17 at the counter portion and rotates in the direction indicated by the arrow E in the figure (clockwise). The supply roller 20 is an elastic sponge roller in which a foam layer is formed at the outer circumference of a conductive metal core thereof. The supply roller 20 and the development roller 17 are brought into contact with each other with the amount of a predetermined intrusion, i.e., the amount of concave ΔE in which the supply roller 20 is concaved by the development roller 17.

The development roller 17 and the photosensitive drum 1 rotate so that each surface thereof move in the same direction. The supply roller 20 supplies the toner to the development roller 17 and removes the toner remaining on the development roller 17 by the operation. The toner led to the upper portion of the supply roller 20 passes through the contact portion (the nip portion) N between the supply roller 20 and the development roller 17 to be charged. The toner that is not supplied to the development roller 17 is guided to a first storage portion 18*c* (an area under the development roller 17 and the supply roller 20 in the development chamber 18) for storing the toner in the development chamber 18. More specifically, the first storage portion 18*c* for storing the toner is provided through under the development blade 21 to under the supply roller 20 in the development chamber 18. The supply roller 20 is arranged so that apart or the whole of the supply roller 20 can be immersed in the toner in the first storage portion 18*c*. The supply roller 20 and the development roller 17 drive to rotate at 200 rpm and at 100 rpm respectively. The supply roller 20 rotates in the direction indicated by the arrow E in the figure and the toner conveyance member 22 rotates in the same direction to rotate in the direction indicated by the arrow G in the figure.

In the present exemplary embodiment, both the supply roller 20 and the development roller 17 are 15 mm in outside diameter. The amount of intrusion of the supply roller 20 into the development roller 17, that is, the amount of concave ΔE in which the supply roller 20 is concaved by the development roller 17 was set to 1.0 mm. The supply roller 20 and the development roller 17 were arranged so that the height in center became equal.

The supply roller 20 used in the present exemplary embodiment is described in detail below. The supply roller 20 in the present exemplary embodiment includes a conductive supporting member and a foam layer supported by the conductive supporting member. More specifically, a foam urethane layer 20*b* as a foam layer formed of an open-cell foam in which foams are connected to each other is provided around a metal core electrode 20*a* being the conductive supporting member with an outside diameter ϕ of 5 mm. The supply roller 20 rotates in the direction indicated by the arrow E in the figure. In the present exemplary embodiment, the supply roller 20 is 220 mm in a longitudinal width.

The open-cell foam is used in the urethane surface-layer to allow a large amount of the toner to enter the supply roller 20. In the present exemplary embodiment, the supply roller 20 has a resistance of $1\times10^{9}\Omega$.

A method for measuring a resistance of the supply roller 20 is described below. The supply roller 20 is caused to abut on an aluminum sleeve with a diameter of 30 mm to such an extent that the amount of intrusion described below reaches 1.5 mm. The aluminum sleeve is rotated to cause the supply roller 20 to be rotationally driven at 30 rpm with respect to the aluminum sleeve.

A DC voltage of −50 V is applied to the development roller 17. In this case, a resistor of 10 kΩ is provided on the ground side and a voltage at both ends thereof is measured to calculate a current, calculating the resistance of the supply roller 20. In the present exemplary embodiment, a surface cell diameter of the supply roller 20 was taken as 50 μm to 1000 μm. Porosity was 0.6.

The cell diameter refers to an average diameter of any section of a foam-cell. The maximum foam-cell area is measured from an enlarged image of any section and a diameter corresponding to complete round is converted from the area to obtain the maximum cell diameter. The cell diameter refers to an average value of diameters of individual cells converted from the other individual cell areas in the same manner after the foam-cell whose diameter is equal to or smaller than ½ of the maximum cell diameter is deleted as noise. The porosity refers to a ratio of the foam-cell in any section. The area of the foam cells is measured from an enlarged image of any section to obtain the total area of the foam-cells, and then the ratio of any section to the total area of the foam-cells is obtained as the porosity.

Configuration for Detection of Remaining Toner Amount

A remaining developer amount detection (hereinafter referred to as "remaining toner mount detection") of a light transmission type according to the present exemplary embodiment is described below with reference to FIG. 6.

As illustrated in FIG. 6, a toner conveyance member 22 provided in the toner containing chamber 19 rotates in the direction G to convey the toner to the upper portion of the supply roller 20.

As illustrated in FIG. 6, the toner conveyance member 22 is composed of an axis member 22*a* of a resin mold and a stirring sheet 22*b* of a flexible sheet member for stirring the toner, one end thereof is attached to the axis member 22*a*. The flexible sheet member 22*b* can be favorably produced using a flexible resin sheet such as polyester film or polyphenylene sulfide film, for example. It is favorable that the flexible sheet member 22*b* is 50 μm to 250 μm in thickness.

The stirring sheet 22*b* in the lateral direction is made longer than a distance from a rotation center O of the toner conveyance member 22 to the toner containing chamber walls W1, W2, and W4 in particular so that even the toner at the bottom of the toner containing chamber can be sufficiently stirred and conveyed. Length W0 of the stirring sheet 22*b* in the longitudinal direction is made equal to the length between the walls on both sides of the toner containing chamber 19 positioned on both sides in the direction of the rotation axis of the toner conveyance member 22.

A driving force is transmitted to the toner conveyance member 22 by a driving gear (not illustrated) inserted into a fitting hole 22*c* provided at the end of the axis member 22*a* through the side face of the toner containing chamber 19.

The light-transmission type remaining toner amount detection unit for detecting the remaining toner amount is arranged in the toner containing chamber 19. In the present exemplary embodiment, a pair of light-transmission members 40 as a developer detecting member for the light-transmission type remaining toner amount detection is arranged face to face along the longitudinal direction of the development roller 17 on the wall forming the toner containing chamber 19 and in particular on the wall of the side face on the downstream side of toner supply.

The light-transmission members 40 respectively include a transmission window as an outgoing part and a transmission window as an incidence part.

The light-transmission members 40 incorporates a light guide (not illustrated) for conducting detection light L emitted from a light emitting diode (LED) as a light emitting unit provided on the electrophotographic image forming apparatus main body 100A with the transmission window capable of transmitting the detection light L. The detection light L passing through the toner containing chamber 19 passes through the light guide (not illustrated) and led to a phototransistor as a light receiving unit provided in the electrophotographic image forming apparatus main body 100A.

Method of the Remaining Toner Amount Detection

The method of the remaining toner amount detection is described in detail below with reference to FIGS. 8A to 8E and FIG. 11.

Figure 8A:
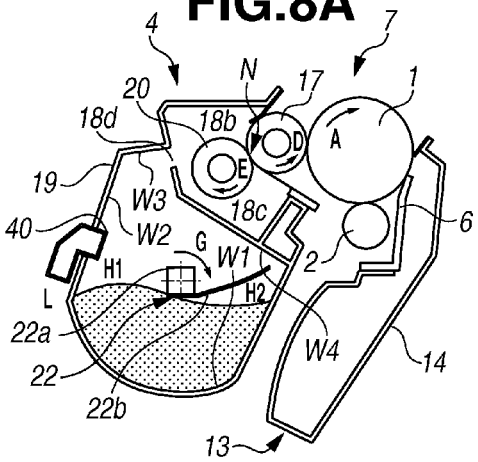
FIGS. 8A, 8B, 8C, 8D, and 8E are schematic cross sections of process cartridges according to the second exemplary embodiment.
Figure 11:
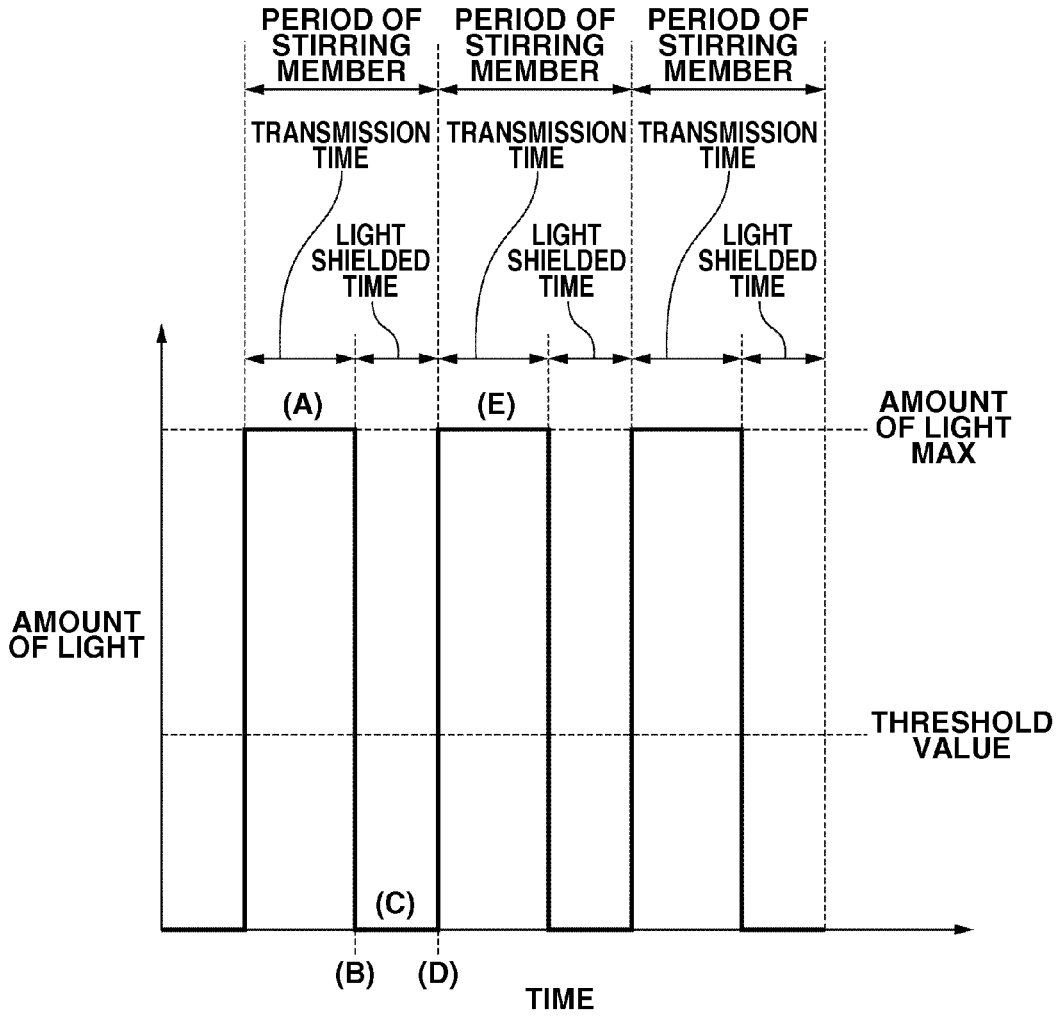
FIG. 11 illustrates a waveform indicating a relationship between time and light amount obtained by a light receiving unit according to the second exemplary embodiment.

FIG. 8A illustrates a state where a predetermined amount of the toner is accumulated in the toner containing chamber 19 and the toner conveyance member 22 is situated above surfaces H1 and H2 of the toner. FIG. 11 illustrates a waveform obtained by the phototransistor (not illustrated). A control unit (not illustrated), provided in the image forming apparatus main body 100A, receiving an electric signal obtained from the phototransistor (not illustrated) according to amount of light measures a time during which the amount of light exceeding a predetermined amount of light (threshold) is received as a transmission time. The toner remaining mount is estimated from the transmission time.

A waveform obtained by the phototransistor (not illustrated) in the state illustrated in FIG. 8A corresponds to a portion (A) in FIG. 11. In other words, the toner does not reach the light transmission member 40, so that the detection light L passes through the toner containing chamber 19.

In this state, the toner conveyance member 22 rotates and the stirring sheet 22*b* presses the surface H2 of the toner on the right side of the toner conveyance member 22 to raise the surface H1 of the toner on the left side of the toner conveyance member 22 in FIG. 8A.

Figure 8B:
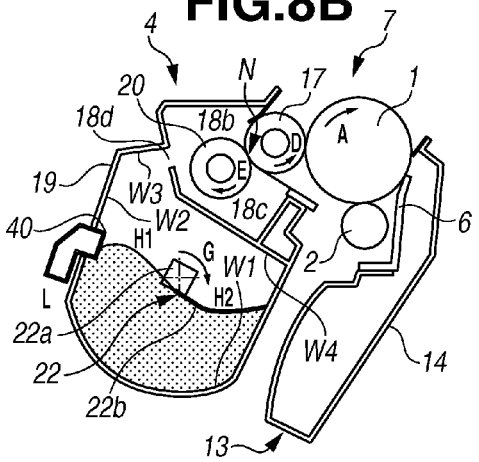

The surface H1 of the toner is further raised along the tiled wall surface W2 of the toner containing chamber 19 to reach the light transmission member 40 as illustrated in FIG. 8B.

Right after that, the toner intervenes between the pair of light-transmission members 40 provided on the wall surface W2 of the toner containing chamber 19 to cut off the detection light L emitted from the LED (not illustrated), receiving the detection light L no longer by the phototransistor (not illustrated) as illustrated in FIG. 11 (state of (B)).

Thereafter, the surface H1 of the toner continues to be raised by the rotation of the toner conveyance member 22 along the wall surface W2 of the toner containing chamber 19.

Figure 8C:
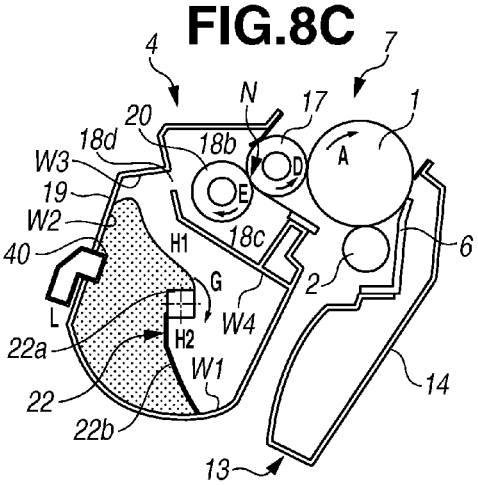

As illustrated in FIG. 8C, when the slope of the toner becomes steep, the toner on the toner stirring sheet 22*b* falls from the toner stirring sheet 22*b* to be accumulated again in the toner containing chamber 19.

At this point, the toner exists in the pair of light-transmission members 40 provided on the wall surface W2 of the toner containing chamber 19 to cut off the detection light L as illustrated in FIG. 11 (state of (C)).

Figure 8D:
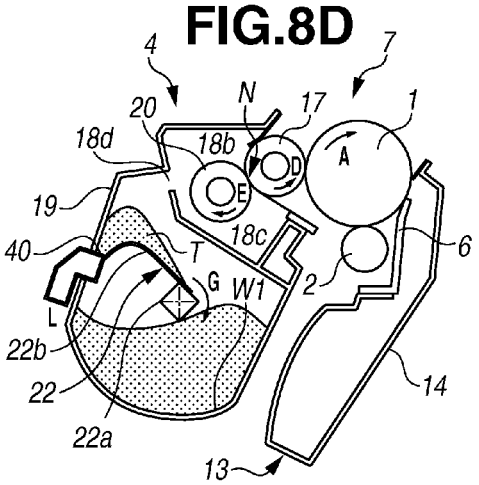

FIG. 8D illustrates a state immediately after the toner conveyance member 22 rotates to cause the toner stirring sheet 22*b* to pass the light-transmission members 40.

The toner on the toner stirring sheet 22*b* raised by the rotation of the toner conveyance member 22 along the wall surface W2 of the toner containing chamber 19 still remains on the stirring sheet 22*b*. However, since the toner stirring sheet 22*b* passes, the toner disappears from the pair of light-transmission members 40 provided on the wall surface W2 of the toner containing chamber 19. The detection light L passes through again the toner containing chamber 19 as illustrated in FIG. 11 (state of (D)).

As described above, the stirring sheet 22*b* in the lateral direction is made longer than a distance R from the center O of the conveyance member 22 to the wall W2 of the toner containing chamber 19. This prevents the toner conveyed lying on the stirring sheet 22*b* from spilling out of the gap between the stirring sheet 22*b* and the wall W2 of the toner containing chamber 19.

After that, the rotation of the conveyance member 22 causes the toner stirring sheet 22*b* to continue carrying the toner along the wall W2 of the toner containing chamber 19. The conveyance member 22 reaches a position where the leading edge of the toner stirring sheet 22*b* is detached and released from the wall W2.

Figure 8E:
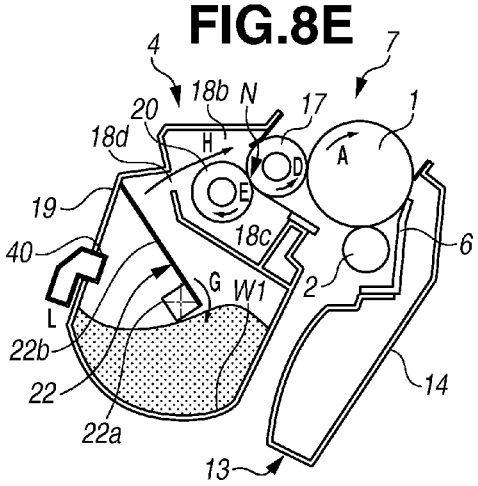

The release of the toner stirring sheet 22*b* straightens the toner stirring sheet 22*b* that is rotated while being bent and flicks the toner lying on the toner stirring sheet 22*b* upward to the upper portion of the supply roller 20 (refer to FIG. 8E).

Although described in detail below, in the present exemplary embodiment, the toner sent to the upper portion of the supply roller 20 by the toner stirring sheet 22*b* is moved to the direction indicated by an arrow H and the supply roller 20 rotates in the same direction (indicated by an arrow E) as the direction in which the toner is moved, so that the toner can be stably accumulated in the second storage portion 18*b*.

At this moment, as illustrated in FIG. 11, the toner supplied to the upper portion of the supply roller 20 is inhibited from falling between the pair of light-transmission members 40 to prevent the detection light L from passing through the light-transmission members 40 (state of (E)). In the present exemplary embodiment, the development chamber is configured such that the lower end of the opening 18*d* is positioned at an upper portion than the lower end of the supply roller 20 to increase the amount of toner storage in the first storage portion 18*c*, inhibiting the toner from falling from the opening 18*d*.

Figure 7:
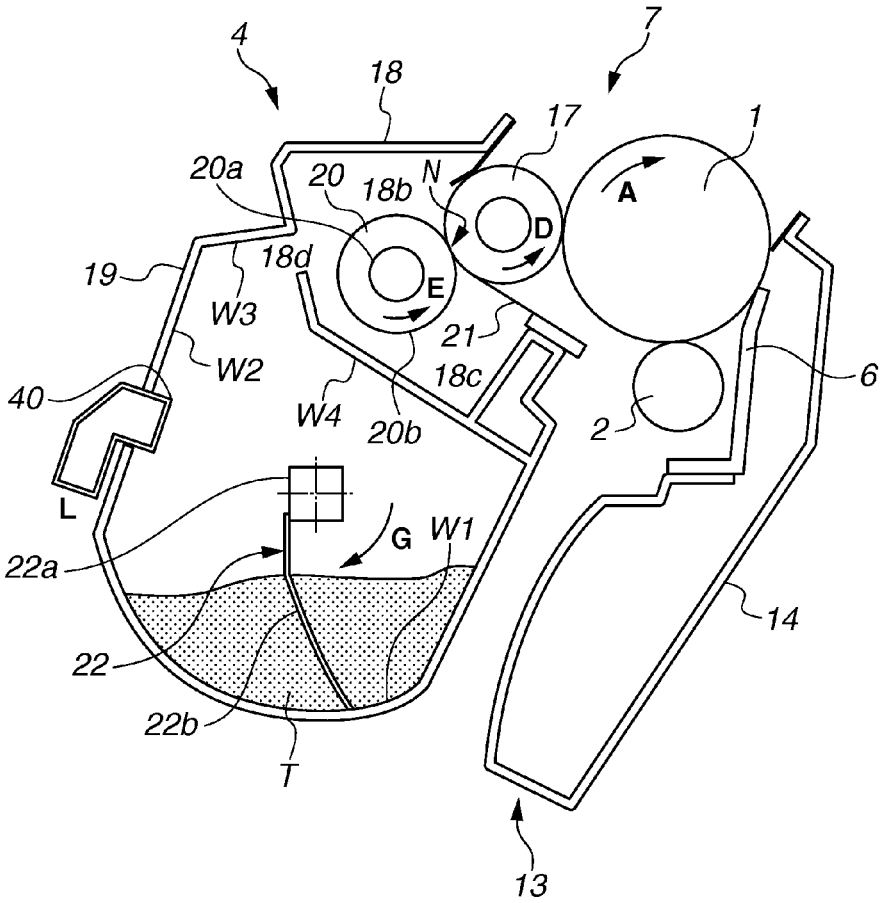
FIG. 7 is a schematic cross section of a conventional process cartridge.
Figure 10:
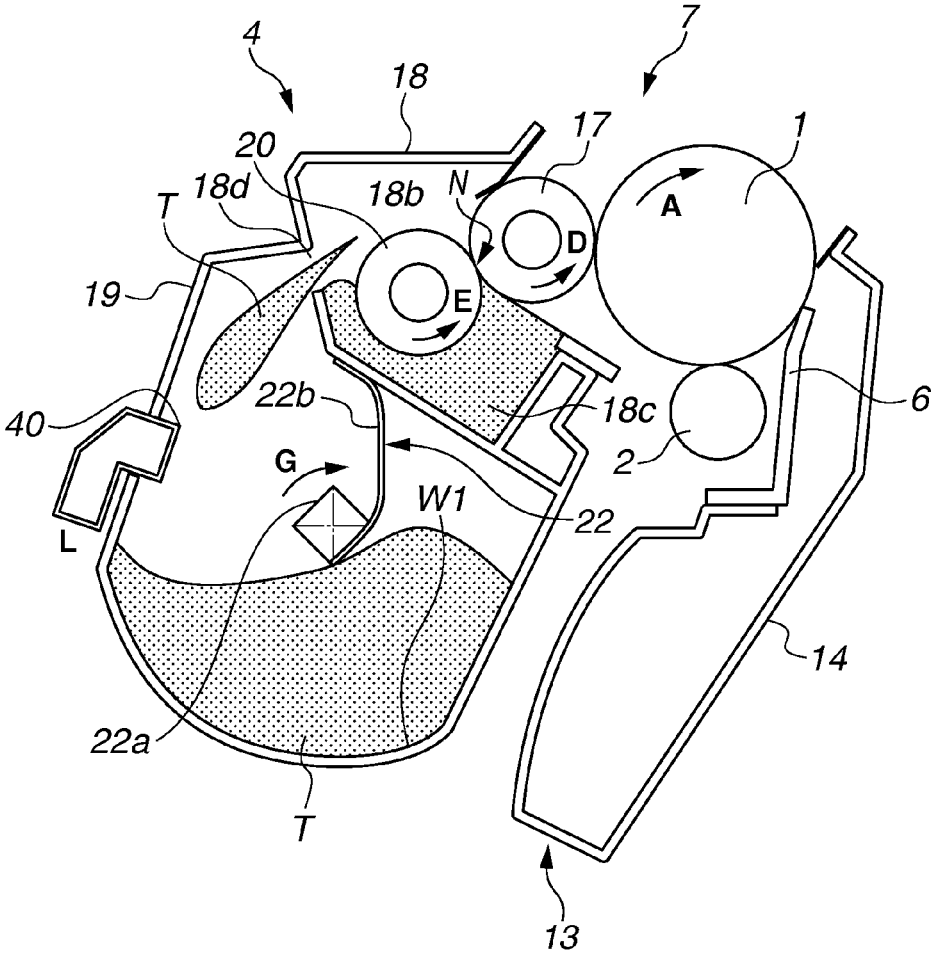
FIG. 10 is a schematic cross section of the development device and the process cartridge in a state where the toner is supplied to a second storage portion according to a conventional configuration.
Figure 12:
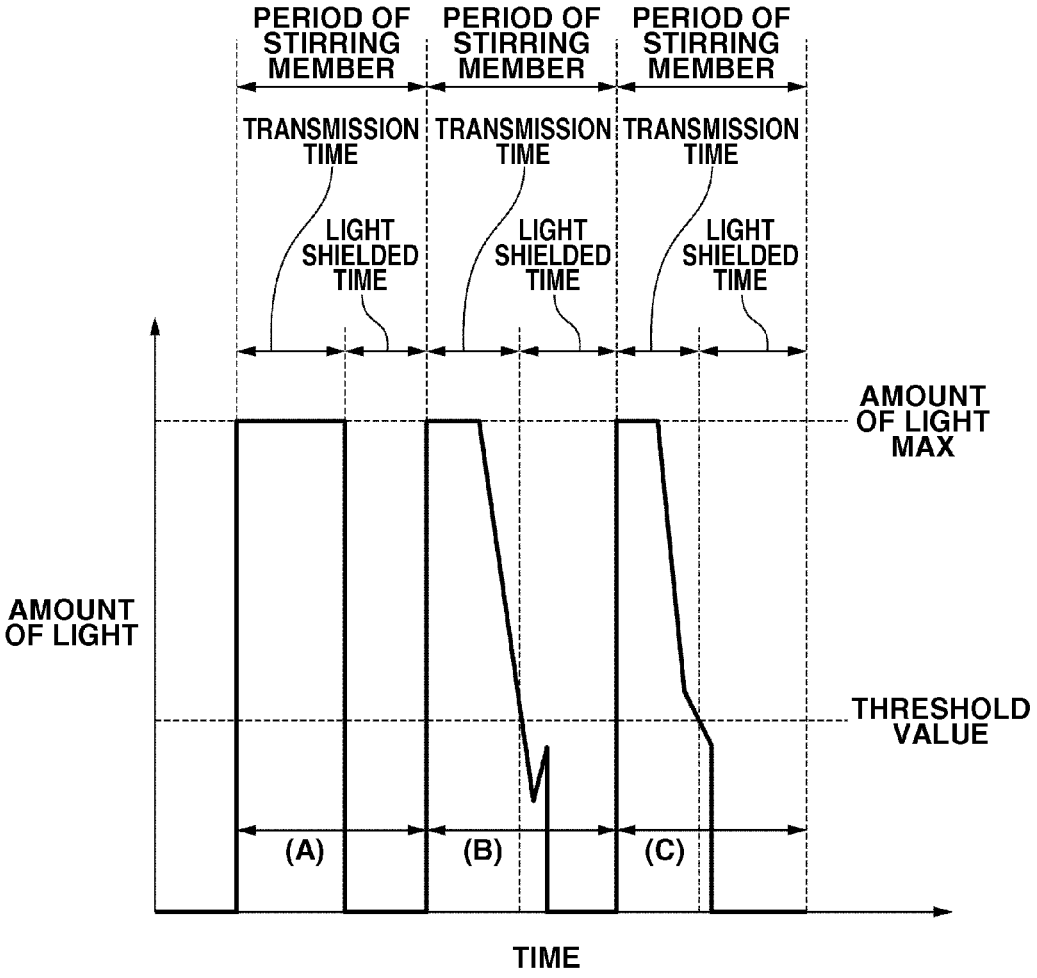
FIG. 12 illustrates a waveform indicating a relationship between time and light amount obtained by the light receiving unit according to the conventional configuration.

For a conventional configuration illustrated in FIG. 7, when the first storage portion 18*c* is not filled with the toner, most of the toner sent to the second storage portion 18*b*, which adheres to the supply roller 20, are instantly moved to and stored in the first storage portion 18*c*. For this reason, there is little toner returned to the toner containing chamber 19 among the toner sent to the upper portion of the supply roller 20, so that the detection light L is not cut off (state of (A) in FIG. 12). After that, when the first storage portion 18*c* is filled with the toner, the supply roller 20 is moved in the direction of the opening 18*d* (in the direction indicated by the arrow E in the figure), so that the toner sent to the upper portion of the supply roller 20 is returned to the toner containing chamber 19 along with the rotation of the supply roller 20 without being stored in the second storage portion 18*b* (refers to FIG. 10). As a result, the detection light L emitted from the LED (not illustrated) was cut off to sometimes lower accuracy in the detection of toner remaining amount (state of (B) and (C) in FIG. 12). Particularly in the toner containing chamber 19, if the light-transmission members 40 are provided at a position opposite to the supply roller 20 with respect to a vertical plane passing the lower end of the opening 18*d*, the problem becomes conspicuous. This is because the toner sent to the upper portion of the supply roller 20 receives a centrifugal force accompanied with the rotation of the supply roller 20 to fall in the direction of the light-transmission members 40. This makes the toner easily reaches between the pair of light-transmission members 40 provided on the wall W2 of the toner containing chamber 19.

Figure 9:
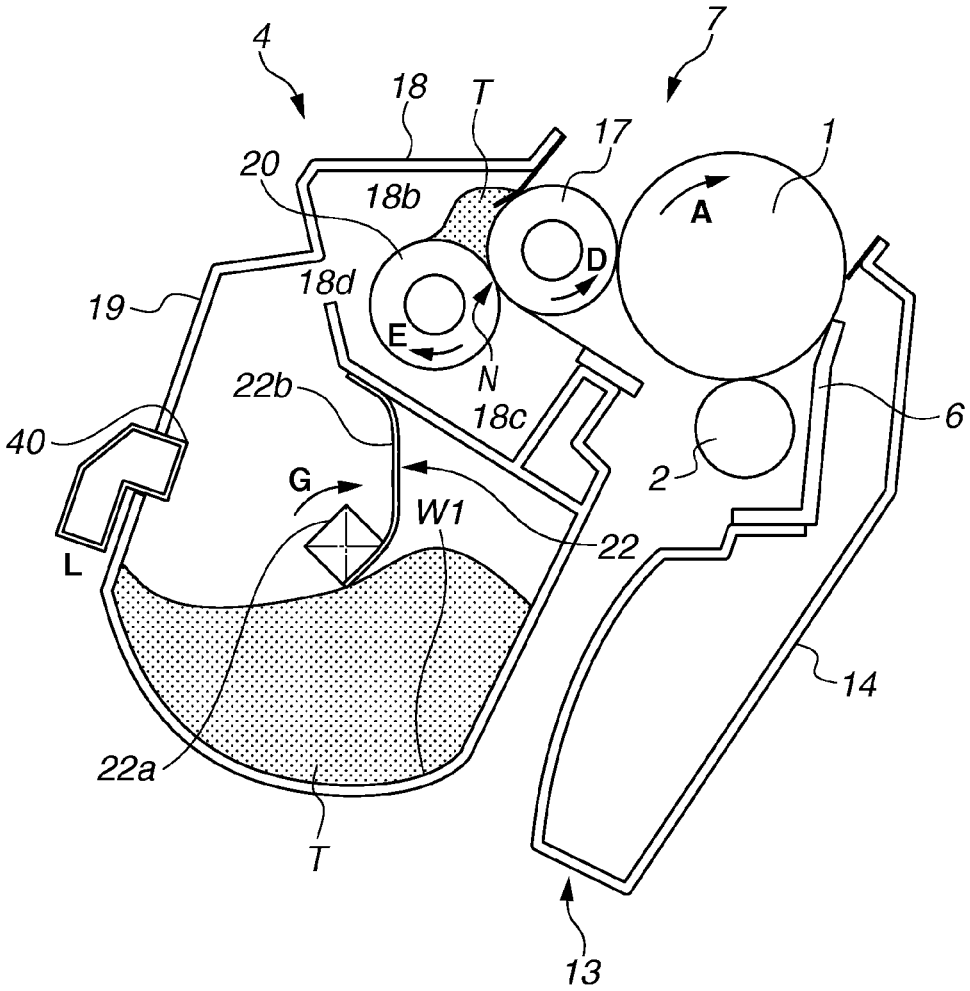
FIG. 9 is a schematic cross section of the development device and the process cartridge in a state where the toner is supplied to a second storage portion according to the second exemplary embodiment.

In the present exemplary embodiment, as illustrated in FIG. 8E, the rotation of the toner conveyance member 22 in the direction indicated by the arrow G in the figure sends the toner to the direction indicated by the arrow H in the figure via the opening 18*d*. The rotation of the supply roller 20 in the direction indicated by the arrow E in the figure assists the toner sent in the direction indicated by the arrow H to be conveyed to the second storage portion 18*b*. More specifically, the supply roller 20 rotates in the direction in which the surface of the supply roller 20 moves from the upper end to the lower end of the nip portion to allow the toner to be stored in the second storage portion 18*b* above the nip portion between the supply roller 20 and the development roller 17 even if the first storage portion 18*c* is filled with the toner (refers to FIG. 9). Therefore, the toner hardly overflows from the opening 18*d*. As a result, the toner is not more liable to fall at the pair of light-transmission members 40 in the present exemplary embodiment than in the conventional configuration to enable inhibiting the remaining toner amount detection from being lowered in accuracy.

If a printing ratio is low, not only the first storage portion 18*c* but also the second storage portion 18*b* can be filled with the toner. At this point, the toner is overflowed from the second storage portion 18*b* and the first storage portion 18*c* to be returned to the toner containing chamber 19. However, the supply roller 20 rotates in the direction in which the surface of the supply roller 20 moves from the upper end to the lower end of the nip portion, so that the toner falls in the gravity direction without spattering from the upper portion of the supply roller 20 to the light-transmission members 40. Therefore, the toner is not more liable to fall at the pair of light-transmission members 40 in the present exemplary embodiment than in the conventional configuration to enable inhibiting the remaining toner amount detection from being lowered accuracy in.

In the present exemplary embodiment, although the development roller 17 rotates in the direction indicated by the arrow D (counterclockwise), the development roller 17 may rotates in the opposite direction.

A third exemplary embodiment of the present invention will be described below. Duplications in the description of the second exemplary embodiment are omitted.

Figure 13:
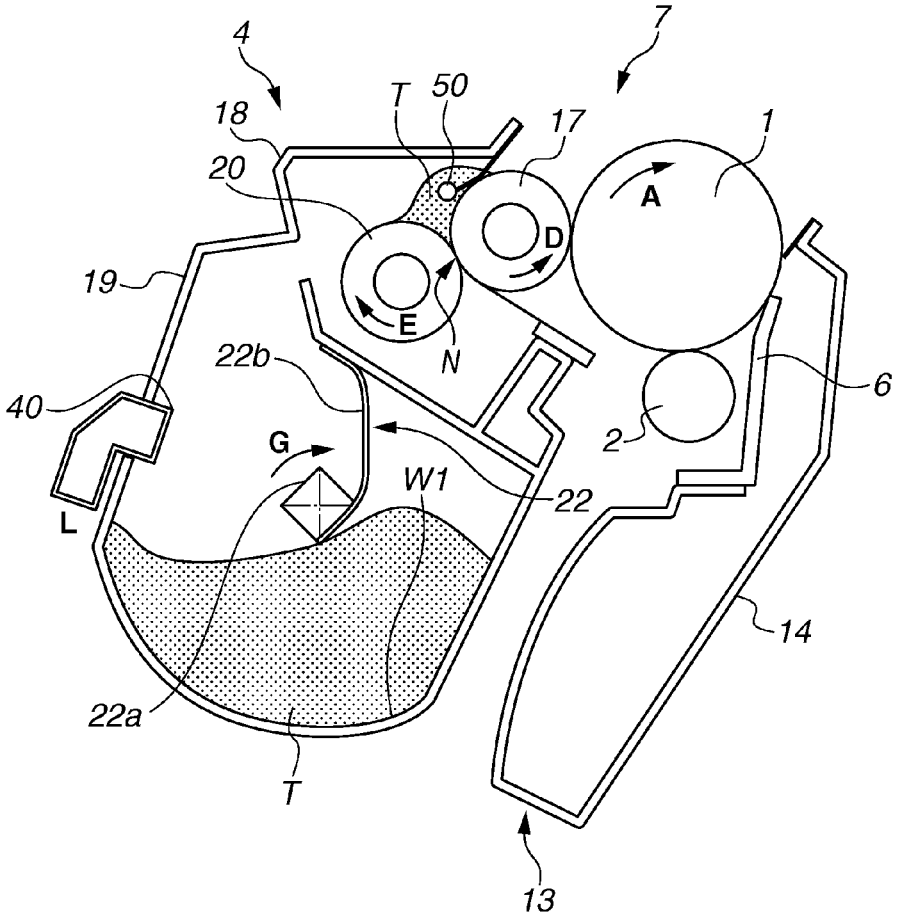
FIG. 13 is a schematic cross section of the development device and the process cartridge according to the third exemplary embodiment.
Figure 14A:
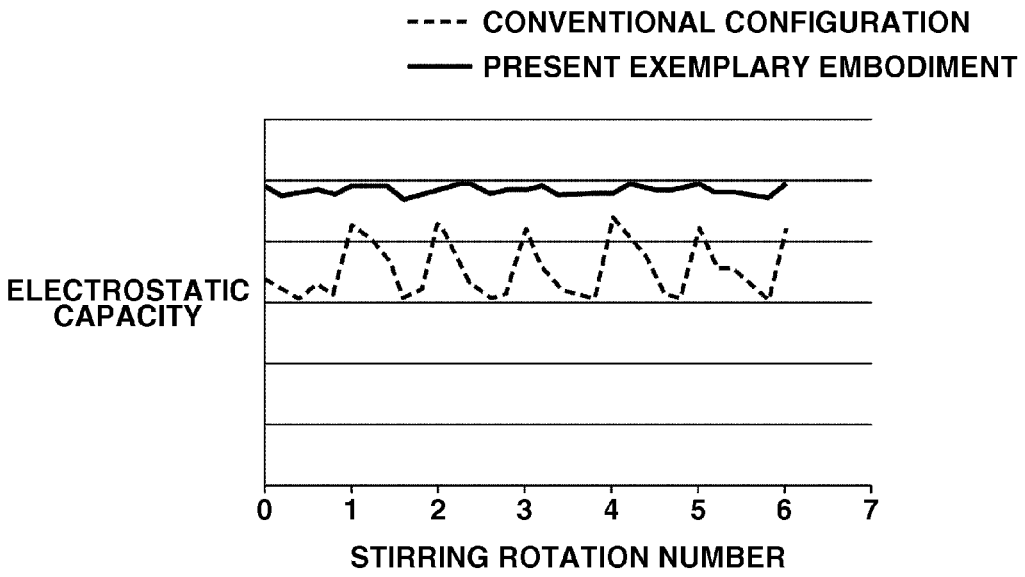
FIGS. 14A and 14B illustrate a relationship between stirring rotation number and electrostatic capacity according to the third exemplary embodiment and a conventional example and a relationship between the remaining amount of the toner and electrostatic capacity according to the second exemplary embodiment.

The third exemplary embodiment is described below with reference to FIGS. 13 and 14. The second exemplary embodiment has described the method of the remaining toner amount detection using the light-transmission members 40 in the toner containing chamber 19. The present exemplary embodiment discusses a method of the remaining toner amount detection in the second storage portion 18*b*.

The present exemplary embodiment has a configuration in which an antenna is provided as an electrode member used in a remaining toner amount detection device. The present exemplary embodiment is similar in other configurations to the second exemplary embodiment. As illustrated in FIG. 13, in the present exemplary embodiment, an antenna 50 for measuring electrostatic capacity is provided in an area where the toner is exactly accumulated in the second storage portion 18*b*. An alternating current (AC) bias with a frequency of 50 KHz and a peak-to-peak voltage (Vpp) of 200 V is used as a bias for the remaining toner amount detection applied to the antenna 50. A detector (not illustrated) is provided in a circuit on a side of the metal core of the supply roller 20.

In the present exemplary embodiment, as is the case with the second exemplary embodiment, the toner is supplied to the second storage portion 18*b* by the toner conveyance member 22, however, other methods may be used other than the method for stirring the toner in the present exemplary embodiment.

In the case of the conventional configuration, the supply roller 20 rotates in the direction indicated by the arrow E in the figure (counterclockwise), so that the toner adhering to the supply roller 20 is sent to the first storage portion 18*c* with the toner adhering to the surface of the supply roller 20. This precludes the toner from being stably stored in the second storage portion 18*b*. As can be seen from FIG. 14A, although the toner conveyance member 22 rotates by one cycle to momentarily increase electrostatic capacity, thereafter the toner in the second storage portion 18*b* is sent to the first storage portion 18*c* to suddenly decrease the electrostatic capacity. In other words, the amount of the toner in the second storage portion 18*b* is varied according to the rotation period of the toner conveyance member 22 to increase measuring dispersion in the remaining toner amount detection.

Figure 14B:
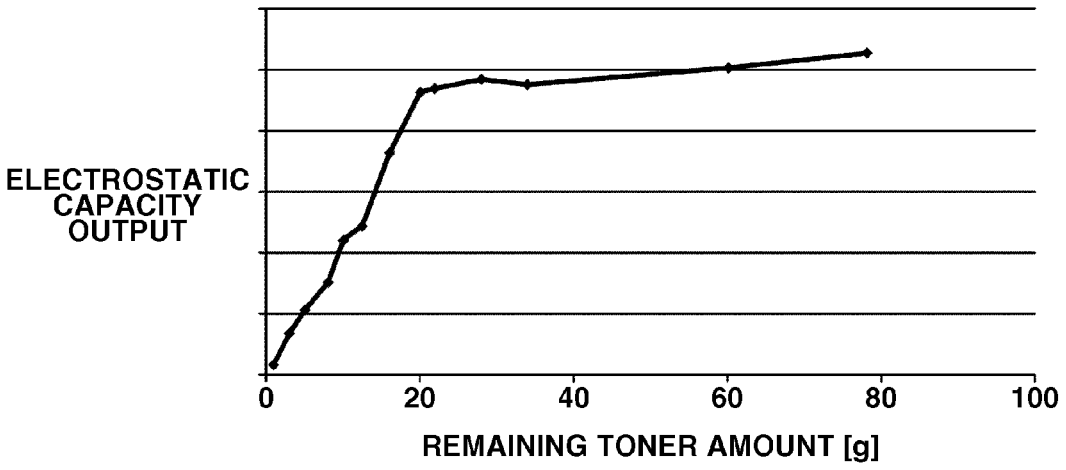

In the present exemplary embodiment, the supply roller 20 characterized by the present exemplary embodiment rotates in the direction indicated by the arrow E in the figure (clockwise), so that the toner adhering to the supply roller 20 is stably stored in the second storage portion 18*b* between the supply roller 20 and the development roller 17. As can be seen from FIG. 14A, a change in the amount of the toner in the second storage portion 18*b* is small during one stirring rotation. A change in electrostatic capacity in the second storage portion 18*b* with respect to the remaining toner amount in the development device is illustrated in FIG. 14B. As can be seen from FIG. 14B, electrostatic capacity can be accurately measured particularly in an area where the amount of the toner is decreased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2012-100954 filed Apr. 26, 2012 and No. 2012-100956 filed Apr. 26, 2012, which are hereby incorporated by reference herein in their entirety.

What is claimed is:

1. A development device used in an electrophotographic image forming apparatus, the development device comprising:

a developer carrier configured to develop an electrostatic latent image by a developer;

a supplying member configured to supply the developer to the developer carrier and rotate in a manner that respective surfaces of the developer carrier and the supplying member moves in a same direction at a nip portion where the developer carrier and the supplying member contact;

a regulation member configured to regulate an amount of the developer to be carried by the developer carrier when the electrostatic latent image is developed;

a development chamber configured to be provided with the developer carrier and the supplying member;

a containing chamber configured so as to be at least partially arranged in a lower side of a bottom of the development chamber and contain the developer;

a conveyance member configured to convey the developer contained in the containing chamber to the development chamber; and a space provided to the development chamber and, according to a rotation of the supplying member, a developer not being carried by the developer carrier moves inside the space toward the containing chamber.

2. The development device according to claim 1, further comprising:

an opening configured to communicate with the developing chamber and the containing chamber, wherein a developer conveyed by the conveyance member passes through the opening, and wherein a lower end of the opening is lower than an upper end of the supplying member.

3. The development device according to claim 1, further comprising:

an opening configured to communicate with the developing chamber and the containing chamber, wherein a developer conveyed by the conveyance member passes through the opening, and wherein a lower end of the opening is lower than a rotational center of the supplying member.

4. The development device according to claim 1, further comprising:

an opening configured to communicate with the developing chamber and the containing chamber, wherein a developer conveyed by the conveyance member passes through the opening; and a transmission member that is provided in the containing chamber and capable of transmitting detection light for detecting the developer, wherein the transmission member is provided at a position opposite to the supplying member with respect to a vertical plane passing a lower end of the opening.

5. The development device according to claim 4, wherein the lower end of the opening is positioned above a lower end of the supplying member.

6. The development device according to claim 1, further comprising an electrode member for detecting the developer positioned above the nip portion.

7. The development device according to claim 1, wherein the supplying member includes a foam member for holding the developer.

8. The development device according to claim 7, wherein the foam member includes an open-cell foam.

9. A process cartridge detachable from a main body of an electrophotographic image forming apparatus comprising:

an image carrier configured to carry an electrostatic latent image; and the development device according to claim 1.

10. The process cartridge according to claim 9, further comprising: an opening configured to communicate with the developing chamber and the containing chamber, wherein a developer conveyed by the conveyance member passes through the opening, and wherein a lower end of the opening is lower than an upper end of the supplying member.

11. The process cartridge according to claim 9, further comprising:

an opening configured to communicate with the developing chamber and the containing chamber, wherein a developer conveyed by the conveyance member passes through the opening, and wherein a lower end of the opening is lower than a rotational center of the supplying member.

12. The process cartridge according to claim 9, further comprising:

an opening configured to communicate with the developing chamber and the containing chamber, wherein a developer conveyed by the conveyance member passes through the opening; and a transmission member that is provided in the containing chamber and capable of transmitting detection light for detecting the developer, wherein the transmission member is provided at a position opposite to the supplying member with respect to a vertical plane passing a lower end of the opening.

13. The process cartridge according to claim 12, wherein the lower end of the opening is positioned above a lower end of the supplying member.

14. The process cartridge according to claim 9, further comprising an electrode member for detecting the developer positioned above the nip portion.

15. The process cartridge according to claim 9, wherein the supplying member includes a foam member for holding the developer.

16. An image forming apparatus for forming an image on a recording medium, comprising:

an image carrier configured to carry an electrostatic latent image; and a development device according to a claim 1.

17. The image forming apparatus according to claim 16, further comprising:

an opening configured to communicate with the developing chamber and the containing chamber, wherein a developer conveyed by the conveyance member passes through the opening, and wherein a lower end of the opening is lower than an upper end of the supplying member.

18. The image forming apparatus according to claim 16, further comprising:

an opening configured to communicate with the developing chamber and the containing chamber, wherein a developer conveyed by the conveyance member passes through the opening, and wherein a lower end of the opening is lower than a rotational center of the supplying member.

19. The image forming apparatus according to claim 16, further comprising:

an opening configured to communicate with the developing chamber and the containing chamber, wherein a developer conveyed by the conveyance member passes through the opening; and a transmission member that is provided in the containing chamber and capable of transmitting detection light for detecting the developer, wherein the transmission member is provided at a position opposite to the supplying member with respect to a vertical plane passing a lower end of the opening.

20. The image forming apparatus according to claim 19, wherein the lower end of the opening is positioned above a lower end of the supplying member.

21. The image forming apparatus according to claim 16, further comprising an electrode member for detecting the developer positioned above the nip portion.

22. The image forming apparatus according to claim 16, further comprising:

an intermediate transfer member configured to be arranged above the image carrier, wherein a developer image is transferred from the image carrier.

23. The image forming apparatus according to claim 16, further comprising an exposure device configured to be arranged below the image carrier and expose the image carrier to form the electrostatic latent image.

24. The development device according to claim 1, wherein an upper end of an inner surface of the containing chamber facing the space is lower than an upper end of the supplying member.

25. The development device according to claim 1, wherein an upper end of an inner surface of the containing chamber facing the space is lower than a rotational center of the supplying member.

26. The development device according to claim 1, wherein the developer carrier and the supplying member rotate in a manner that the respective surfaces of the developer carrier and the supplying member moves downward at the nip portion.

27. The development device according to claim 1, wherein the space is a first space and, the development device further comprises a second space configured to be positioned above the nip portion in the development chamber, the conveyance member conveys the developer toward the second space from the containing chamber, and the first space is positioned below the second space.

28. The development device according to claim 27, wherein the supply member discharges the developer to the second space.

29. The development device according to claim 1, wherein the conveyance member rotates to convey the developer, a rotational center of the conveyance member is positioned below an upper end of an inner surface of the containing chamber facing the space.

30. The development device according to claim 1, wherein the conveyance member rotates to convey the developer, revolutions per unit time of the developer carrier is larger than the revolutions per unit time of the conveyance member, and revolutions per unit time of the supplying member is larger than the revolutions per unit time of the developer carrier.

31. The development device according to claim 1, wherein a distance between a lower end of the supplying member and an inner surface of the development chamber facing the space in a gravity direction is equal to or less than 5 mm.

32. The development device according to claim 1, further comprising:

an opening configured to communicate with the developing chamber and the containing chamber, wherein a developer conveyed by the conveyance member passes through the opening, and wherein the supply member rotates to convey the developer in the space toward the opening in a manner that a surface thereof facing the space moves toward the opening.

33. The development device according to claim 1, wherein peripheral velocity of the supplying member is higher than peripheral velocity of the developer carrier.

34. A development device used in an electrophotographic image forming apparatus, the development device comprising:

a developer carrier configured to develop an electrostatic latent image by a developer;

a supplying member configured to supply the developer to the developer carrier and rotate in a manner that a surface thereof moves downward at a nip portion where the developer carrier and the supplying member contact;

a regulation member configured to regulate an amount of the developer to be carried by the developer carrier when the electrostatic latent image is developed;

a development chamber configured to be provided with the developer carrier and the supplying member;

a containing chamber configured so as to be at least partially arranged in a lower side of a bottom of the development chamber and contain the developer;

a conveyance member configured to convey the developer contained in the containing chamber to the development chamber; and a space provided to the development chamber and, according to a rotation of the supplying member, a developer not being carried by the developer carrier moves inside the space toward the containing chamber, wherein an upper end of an inner surface of the containing chamber facing the space is lower than a rotational center of the supplying member.

35. The development device according to claim 34, further comprising an electrode member for detecting an amount of developer positioned above the nip portion.

36. The development device according to claim 34, wherein the supplying member includes a foam member for holding the developer.

37. The development device according to claim 36, wherein the foam member includes an open-cell foam.

38. The development device according to claim 34, wherein the space is a first space, wherein the development device further comprises a second space configured to be positioned above the nip portion in the development chamber, wherein the conveyance member conveys the developer toward the second space from the containing chamber, and wherein the first space is positioned below the second space.

39. The development device according to claim 38, wherein the supply member discharges the developer to the second space.

40. The development device according to claim 34, wherein the conveyance member rotates to convey the developer, and wherein a rotational center of the conveyance member is positioned below an upper end of an inner surface of the containing chamber facing the space.

41. The development device according to claim 34, wherein the conveyance member rotates to convey the developer, wherein revolutions per unit time of the developer carrier is larger than the revolutions per unit time of the conveyance member, and wherein revolutions per unit time of the supplying member is larger than the revolutions per unit time of the developer carrier.

42. The development device according to claim 34, wherein a distance between a lower end of the supplying member and an inner surface of the development chamber facing the space in a gravity direction is equal to or less than 5 mm.

43. The development device according to claim 34, further comprising: an opening configured to communicate with the developing chamber and the containing chamber, wherein a developer conveyed by the conveyance member passes through the opening, and wherein the supply member rotates to convey the developer in the space toward the opening in a manner that a surface thereof facing the space moves toward the opening.

44. The development device according to claim 34, wherein peripheral velocity of the supplying member is higher than peripheral velocity of the developer carrier.

* * * * *